US010136707B2

(12) United States Patent
Kojima et al.

(10) Patent No.: US 10,136,707 B2
(45) Date of Patent: Nov. 27, 2018

(54) FASTENER ELEMENT, FASTENER STRINGER AND SLIDE FASTENER

(71) Applicant: YKK Corporation, Tokyo (JP)

(72) Inventors: Masayoshi Kojima, Toyama (JP); Hideki Sato, Toyama (JP); Kinue Yoshimoto, Toyama (JP)

(73) Assignee: YKK Corporation (JP)

( * ) Notice: Subject to any disclaimer, the term of this patent is extended or adjusted under 35 U.S.C. 154(b) by 23 days.

(21) Appl. No.: 15/513,663

(22) PCT Filed: Sep. 24, 2014

(86) PCT No.: PCT/JP2014/075261
§ 371 (c)(1),
(2) Date: Mar. 23, 2017

(87) PCT Pub. No.: WO2016/046915
PCT Pub. Date: Mar. 31, 2016

(65) Prior Publication Data

US 2017/0280832 A1 Oct. 5, 2017

(51) Int. Cl.
*A44B 19/06* (2006.01)
*A44B 19/26* (2006.01)
(Continued)

(52) U.S. Cl.
CPC ..... *A44B 19/06* (2013.01); *A44B 19/26* (2013.01); *A44B 19/343* (2013.01); *A44B 19/346* (2013.01); *A44B 19/403* (2013.01)

(58) Field of Classification Search
CPC ..... A44B 19/06; A44B 19/403; A44B 19/26; A44B 19/346; A44B 19/343; Y10T 24/2552; Y10T 24/255; Y10T 24/2539
See application file for complete search history.

(56) References Cited

U.S. PATENT DOCUMENTS 2,392,338 A 1/1946 Polk
2,790,223 A * 4/1957 Morin ..... A44B 19/04 24/410
(Continued)

FOREIGN PATENT DOCUMENTS

JP 55-133207 A 10/1980
JP 2003-299509 A 10/2003
(Continued)

OTHER PUBLICATIONS

International Search Report, PCT Application No. PCT/JP2014/075261, dated Dec. 16, 2014.

*Primary Examiner* — Robert Sandy
*Assistant Examiner* — Rowland Do
(74) *Attorney, Agent, or Firm* — Kilpatrick Townsend & Stockton LLP

(57) ABSTRACT

A fastener element has a central land portion and first and second bulging portions bulging from the central land portion toward the tape front surface side and the tape rear surface side in the element thickness direction. The first and second bulging portions respectively have a bulging end surface facing to the element thickness direction. The bulging end surface has a quadrilateral base end surface which is long in the element length direction and a tapered protrusion end surface protruding from the base end surface in the element width direction. Thus, it is possible to make the fastener element look like a single-sided metal element and to make a slide fastener which is formed by using the fastener elements lighter than a conventional slide fastener having single-sided metal elements.

12 Claims, 13 Drawing Sheets

(51) Int. Cl.
*A44B 19/40* (2006.01)
*A44B 19/34* (2006.01)

(56) References Cited

U.S. PATENT DOCUMENTS

| | | | | | |
|---|---|---|---|---|---|
| 3,055,069 | A | * | 9/1962 | Morin | A44B 19/04 24/410 |
| 3,114,952 | A | * | 12/1963 | Morin | A44B 19/403 24/410 |
| 3,825,978 | A | * | 7/1974 | Sakalys | A44B 19/04 24/405 |
| 4,263,698 | A | | 4/1981 | Moertel | |
| 4,520,535 | A | * | 6/1985 | Kasai | A44B 19/06 24/410 |
| 7,337,509 | B2 | * | 3/2008 | Kondo | A44B 19/08 24/405 |
| 8,448,304 | B2 | * | 5/2013 | Tsao | A44B 19/06 24/412 |
| 9,215,912 | B2 | * | 12/2015 | Kondo | A44B 19/04 |
| 9,462,854 | B2 | * | 10/2016 | Kojima | A44B 19/06 |
| 2003/0192150 | A1 | | 10/2003 | Aoki et al. | |
| 2009/0013505 | A1 | | 1/2009 | Hasegawa et al. | |

FOREIGN PATENT DOCUMENTS

| | | | |
|---|---|---|---|
| JP | 2009-034495 | A | 2/2009 |
| WO | 2012-004871 | A1 | 1/2012 |
| WO | 2013/051149 | A1 | 4/2013 |

* cited by examiner

FASTENER ELEMENT, FASTENER STRINGER AND SLIDE FASTENER

TECHNICAL FIELD

The invention relates to a fastener stringer in which a plurality of fastener elements made of synthetic resin are arranged by injection molding at a tape side edge part of a fastener tape. In particular, the invention relates to a fastener stringer in which each fastener element made of synthetic resin has an appearance like a metal fastener element.

BACKGROUND ART

Known as a fastener element which is conventionally used for a slide fastener are a fastener element made of synthetic resin formed individually by injection-molding the synthetic resin to a fastener tape, a continuous fastener element formed by molding monofilaments in a coiled shape or a zigzag shape, a fastener element made of metal (hereinafter "metal element") formed by clamping an approximately Y-shaped metal element material to the fastener tape and the like.

Further generally, as a metal element, a so-called single-sided metal element described in Japanese Patent Publication No. 2003-299509 (Patent Document 1), for example, or a so-called double-sided metal element described in Japanese Patent Publication No. 2009-34495 (Patent Document 2) are known.

A single-sided metal element 70 described in Patent Document 1 has, as shown in FIG. 19, a coupling head portion 70*a* formed by a pressing process and the like, a body portion 70*b* extending from the coupling head portion 70*a*, and a pair of leg portions 70*c* extending and branching as two-pronged from the body portion 70*b*. A coupling convex portion 70*d* is provided on one surface (top surface) of the coupling head portion 70*a* and a coupling concave portion not shown in Figures is provided on the other surface (bottom surface) of the coupling head portion 70*a*.

Such a single-sided metal element 70 is manufactured by manufacturing Y-shaped element materials by slicing a long linear material (Y bar) whose cross section is Y-shaped and which is processed by multistage rolling process in a length direction at a desired thickness and by forming the coupling convex portion 70*d* and the coupling concave portion by pressing and deforming a part corresponding to the coupling head portion 70*a* of the obtained element material partially by the pressing process and the like.

The manufactured single-sided metal element 70 is attached to a fastener tape 71 by being pressed and plastically deformed in a direction in which both leg portions 70*c* come close to each other (inner side) in a state that a tape side edge part of the fastener tape 71 is inserted between a pair of leg portions 70*c*.

When the single-sided metal element 70 attached to the fastener tape 71 is viewed from a tape front and rear direction, the single-sided metal element 70 has an appearance to have an rectangular-shaped base portion 72 and a protrusion portion 73 protruding from a tip end part of the base portion 72 (an end part on the coupling head portion 70*a* side) toward one direction of the tape length direction in a triangular shape.

In contrast, a double-sided metal element 80 described in Patent Document 2 has, as shown in FIGS. 20 and 21, a coupling head portion 80*a*, a body portion 80*b* extending from the coupling head portion 80*a*, and a pair of leg portions 80*c* extending and branching as two-pronged from the body portion 80*b*. Further, one coupling convex portion and one coupling concave portion are formed on both one surface (top surface) and the other surface (bottom surface) of the coupling head portion 80*a*, and the coupling head portion 80*a* has a symmetrical shape in an element thickness direction (a sliding direction of the slider).

The double-sided metal element 80 in Patent Document 2 is attached to a fastener tape 81 by being pressed and plastically deformed in a direction in which both leg portions 80*c* are close to each other (inner side) in a state that a tape side edge part of the fastener tape 81 is inserted between the pair of leg portions 80*c*.

Here, for example, in a slide fastener having two sliders, when the slider slides in a top or a bottom direction with respect to an element row and for example in a case that the element row is formed of such single-sided metal elements 70 as in Patent Document 1, the operability is different between two sliders. On the other hand, in a case that the element row is formed of such double-sided metal elements 80 as in Patent Document 2, it can be prevented that the operability is different between two sliders.

Meanwhile, a fastener element made of synthetic resin is generally fixed to a fastener tape directly by injection molding. Therefore, by widening a fixing area of the fastener element with respect to the fastener tape, a fixing strength of the fastener element with respect to the fastener tape can be enhanced. Accordingly, in a conventional fastener element made of synthetic resin, an element width dimension of each fastener element is set to be large so as to secure the fixing strength of the fastener element stably.

In contrast, the above-mentioned metal element (single-sided and double-sided metal elements) is attached to the fastener tape by being pressed and plastically deformed in a direction in which both leg portions come close to each other (inner side) in a state that the tape side edge part of the fastener tape between a pair of leg portions is inserted between a pair of leg portions. Further, the metal element has more toughness than the fastener element made of synthetic resin. Therefore, the metal element can obtain enough fixing strength easily without setting the element width dimension large as in the case of the fastener element made of synthetic resin, for example.

Accordingly, the metal element can make an appearance of the element look slim by narrowing the element width dimension in comparison to the fastener element made of synthetic resin. Therefore, a product to which a slide fastener having the metal elements is attached (a fastener attached product) looks stylish or has a fashionable impression, which enables the appearance quality to be enhanced. On the other hand, since the metal element is heavier than the fastener element made of synthetic resin, it has a defect that weight of the fastener attached product increases.

In International Publication No. 2013/051149 (Patent Document 3), as a fastener element which has merits of both the conventional metal element and the fastener element made of synthetic resin, a fastener element made of synthetic resin which is lighter than the metal element and has such a slim appearance as the metal element (double-sided metal element) is described.

A fastener element 90 made of synthetic resin described in Patent Document 3 has, as shown in FIGS. 22 and 23, a central land portion 91 disposed at a center part in an element thickness direction, a first bulging portion 92 bulging from the central land portion 91 to a tape front surface side in the element thickness direction, and a second bulging portion 93 bulging from the central land portion 91 to a tape rear surface side in the element thickness direction.

The central land portion 91 has a body portion 91*a* fixed to a fastener tape 98, a neck portion 91*b* extending from the body portion 91*a* to a tape outward side in an element length direction, an oblong-shaped coupling head portion 91*c* further extending from the neck portion 91*b* in the element length direction, a shoulder portion 91*d* extending from the neck portion 91*b* in an element width direction, and a fin portion 91*e* extending from the body portion 91*a* to a tape inner side.

The first bulging portion 92 and the second bulging portion 93 are formed in a front-rear symmetrical shape about a reference surface positioned at a center of the fastener tape 98 in the tape thickness direction. In this case, the first bulging portion 92 has an upper end surface 94 facing to the element thickness direction and top and bottom sloped side surfaces 95 declining from a side edge of the upper end surface 94 to the central land portion 91.

The first bulging portion 92 has a quadrangular-shaped base body portion 96 disposed onto the body portion 91*a* of the central land portion 91 and an extending portion 97 extending from the base body portion 96 to the tape outward, and has a tapered element shape decreasing the element width dimension toward a tip end part of the extending portion 97 in viewing the whole first bulging portion 92 from an upper surface side.

Since the fastener element 90 having such a shape as Patent Document 3 is formed of synthetic resin, it is lighter than the metal fastener element. Further, the fastener element 90 secures the fixing strength to the fastener tape 98 at the body portion 91*a* of the central land portion 91.

At the same time, the fastener element 90 is formed so as to look slimmer than the conventional and general fastener element made of synthetic resin by having the first and second bulging portions 92, 93. Thus, it has such an appearance (visual) as the double-sided metal element.

Therefore, the slide fastener in which the fastener elements 90 in Patent Document 3 are attached to the fastener tape 98 looks stylish and has a fashionable impression as a slide fastener having the double-sided metal elements. At the same time, it is far lightweight in comparison to the slide fastener having the double-sided metal elements.

PRIOR ART DOCUMENTS

Patent Documents

Patent Document 1: Japanese Patent Publication No. 2003-299509

Patent Document 2: Japanese Patent Publication No. 2009-34495

Patent Document 3: International Publication No. WO2013/051149

SUMMARY OF INVENTION

Problem to be Solved by the Invention

The fastener element 90 made of synthetic resin described in Patent Document 3 has the above-mentioned shape, thereby the fixing strength with respect to the fastener tape 98 can be secured. In addition, the fastener element 90 made of synthetic resin has an appearance like the double-sided metal element and enables the slide fastener to be lightweight in comparison to the double-sided metal element.

Meanwhile, as a conventional metal element, as shown in FIG. 19, a single-sided metal element 70 having a different shape from a double-sided metal element 80 is often used other than the double-sided metal element 80 shown in FIGS. 20, 21. Recently, slide fasteners attached to several goods, particularly commodities such as clothes, bags and shoes are more and more regarded as one kind of design, and regarding the fastener element used to the slide fastener, not the double-sided metal element but the single-sided metal element is often preferred depending on a product to which the slide fastener is attached.

However, though the conventional single-sided metal element can make its appearance look slim in comparison to the fastener element made of synthetic resin as in a case of the double-sided metal element, it has a defect that the slide fastener becomes heavy. Therefore, the development of a fastener element made of synthetic resin which has an appearance like the single-sided metal element as well as secures the fixing strength with respect to the fastener tape has been desired.

Further, since the shape of the coupling head portion is different on one surface side (top surface side) and on the other surface side (bottom surface side) in the tape length direction in the conventional single-sided metal element, in a case that the single-sided metal element is used for, for example, a slide fastener having two sliders, there is a problem specific to the single-sided metal element that the difference in the operability arises between two sliders as described above. Accordingly, it has been desired that the problems specific to the conventional single-sided metal element are resolved when a fastener element made of synthetic resin having an appearance like the single-sided metal element is developed.

The present invention was made in the light of the above conventional problem. The specific objective is to provide a fastener element which is lighter than the single-sided metal element, has an appearance similar to the single-sided metal element and does not cause the difference in the operability between two sliders even when it is used for a slide fastener having two sliders, and also to provide a fastener stringer and a slide fastener in which such a plurality of fastener elements are fixed to the fastener tape.

Means for Solving the Problem

To achieve the above object, a fastener element provided by the present invention is the one for a slide fastener made of synthetic resin which is injection-molded at tape side edge parts of fastener tapes, and has a central land portion fixed to the fastener tape and first and second bulging portions bulging from the central land portion to a tape front surface side and a tape rear surface side in an element thickness direction wherein the central land portion has a body portion fixed to the fastener tape with a predetermined dimension in an element width direction, a neck portion extending from the body portion to a tape outward side in an element length direction and a coupling head portion further extending from the neck portion in the element length direction, being most principally characterized in that the first and second bulging portions have a bulging end surface facing upward or downward in the element thickness direction and a pair of top and bottom side wall surfaces formed from top and bottom side edges of the bulging end surface to the central land portion respectively, the bulging end surface has a quadrilateral-shaped base end surface which is composed of four sides of a tip end edge on the coupling head portion side, a tail end edge on the body portion side and the pair of side edges connecting both ends of the tip end edge and both ends of the tail end edge and is also long in the element length direction and a protrusion end surface protruding from only a part of one of the side edge out of the pair of top and bottom side edges of the base end surface in the element width direction, and the protrusion end surface is formed on the coupling head portion and has a shape which tapers gradually toward a protrusion direction from the base end surface.

In the fastener element according to the present invention, it is preferable that the base end surface has a trapezoidal shape with the tip end edge as an upper base, the tail end edge as a lower base and the pair of side edges as a pair of oblique sides, and the lower base is formed to be longer than the upper base. In this case, it is preferable that the length of the lower base is set to be 1.2 times or smaller of the length of the upper base, and that the pair of top and bottom side edges of the base end surface are formed as a curved line curving concavely toward an inside.

It is preferable that in the fastener element of the present invention, the protrusion end surface is declined from the base end surface in the element width direction. Further, it is preferable that the base end surface has a sloped surface declining toward the tip end edge in the element length direction.

It is also preferable that the base end surface is disposed only in a region inside of the neck portion of the central land portion in the element width direction.

In the fastener element of the present invention, it is preferable that the protrusion end surface is formed as a plain surface or a convex curved surface, and at least a part disposed on an opposite side of the protrusion end surface out of the side wall surfaces across the base end surface declines toward the central land portion and is formed as a concave curved surface.

Further, in the fastener element of the present invention, it is preferable that the central land portion further has a shoulder portion extending from the neck portion in the element width direction and a concave groove portion concaved at a tip end part of the coupling head portion, and is formed in a front-rear symmetrical shape about a reference surface positioned at a center of the fastener tape in the tape thickness direction.

Further, the central land portion may have a first half portion disposed on a tape front surface side of the reference surface positioned at the center of the fastener tape in the tape thickness direction and a second half portion disposed on a tape rear surface side of the reference surface, and the first half portion and the second half portion are in a displaced position each other in the element width direction.

Next, by the present invention, a fastener stringer in which a plurality of the fastener elements having the above structure are fixed to tape side edge parts of the fastener tape is provided. Further, by the present invention, a slide fastener which has a pair of fastener stringers as described above and a slider attached to element rows made of a plurality of the fastener elements is provided.

Effects of the Invention

The fastener element according to the present invention has a central land portion fixed to a fastener tape, a first bulging portion bulging from the central land portion to a tape front surface side in an element thickness direction, and a second bulging portion bulging from the central land portion to a tape rear surface side in the element thickness direction. The central land portion has a body portion fixed to the fastener tape with a predetermined dimension in an element width direction, a neck portion extending from the body portion to a tape outward side in an element length direction and a coupling head portion further extending from the neck portion, and is formed in a top-bottom symmetrical shape by a center part in the element width direction.

The first and second bulging portions of the fastener element have a bulging end surface which becomes a design surface facing upward or downward in the element thickness direction and a pair of top and bottom side wall surfaces formed from the top and bottom side edges of the bulging end surface to the central land portion respectively. Further, each bulging end surface of the first and second bulging portions has a quadrilateral-shaped base end surface which is long in the element length direction and a protrusion end surface protruding from only an end part on the coupling head portion side at one side edge (top side edge or bottom side edge) out of a pair of top and bottom side edges of the base end surface in the element width direction.

In this case, the quadrilateral-shaped base end surface has a tip end edge on the coupling head portion side, a tail end edge on the body portion side, a top side edge and a bottom side edge as the four sides. Here, quadrilateral means a plain figure surrounded by four line segments as sides (limited straight line). A side includes not only a line segment but also a curved line (refer to "Kojien (Fifth edition)" dictionary published by Iwanami Shoten Publishers). The protrusion end surface is formed on the coupling head portion of the central land portion and has a tapered shape (for example, triangular shape) gradually decreasing a dimension in the element length direction toward a protrusion direction from a side edge of the base end surface.

In such a fastener element, since the upper and lower bulging end surfaces which become the design surfaces of the first and second bulging portions are formed of the quadrilateral-shaped base end surface which is long in the element length direction and the tapered (triangular-shaped) protrusion end surface protruding from the base end surface to only one direction of a top and bottom direction, when the fastener element is viewed from, for example, the tape front and rear direction side of the fastener tape, it can look like the single-sided metal element, for example as shown in FIG. 19.

Accordingly, by manufacturing a slide fastener by injection-molding such fastener elements made of synthetic resin to a fastener tape, a slide fastener which is lighter than that having the conventional single-sided metal elements and in which each fastener element made of synthetic resin has an appearance similar to the single-sided metal element can be obtained.

In the fastener element of the present invention, different from the conventional single-sided metal element, the central land portion disposed at a center part in the element thickness direction is formed symmetrical in a slider sliding direction (a top and bottom direction) by a center part in the element width direction. Accordingly, even if the fastener element of the present invention is used for a slide fastener having two sliders attached to element rows in an opposing direction to each other, it is prevented that the difference in the operability between these two sliders occurs.

In such a fastener element of the present invention, the base end surface of the bulging end surface has a trapezoidal shape in which a tip end edge on the coupling head portion side of the bulging end surface is an upper base, a tail end edge on a leg portion side is a lower base, a pair of top and bottom side edges are a pair of oblique sides, and the lower base is formed to be longer than the upper base.

For example in a case that the base end surface of the bulging end surface of the fastener element is formed to be a rectangle, though an appearance of the fastener element can be looked closer to the single-sided metal element, the following problem turned to be occurred.

That is, in a case of forming the base end surface to be a rectangle, the length of the tip end edge on the coupling head portion side and the tail end edge on the leg portion side which become short sides of the rectangle in the base end surface become the same. It should be noted that the length on the short side at the tip end edge on the coupling head portion side and the tail end edge on the leg portion side cannot be longer than the element width dimension of the neck portion in light of product features and moldability of the fastener element. In this case, if the length of the tip end edge on the coupling head portion side becomes long to some extent within the above-mentioned range (that is, a rectangle becomes relatively wider), in a slide fastener formed by using such a fastener element, when a part of the slide fastener is bent strongly in a direction in which the first bulging portions (or the second bulging portions) of the fastener element are made to be close by receiving a push-up force and the like in a state of coupling left and right fastener elements, a tip end part (an end part on the coupling head portion side) of the first bulging portion (or the second bulging portion) of one fastener element row out of the left and right element rows and the first bulging portion (or the second bulging portion) of the other fastener element bump and easily interfere with each other.

Then, if such an interference increases between the left and right fastener elements, the force with which the left and right fastener elements move away from each other tends to work by the interfering part as a fulcrum point, then the position of the fastener element may lean in the tape front and rear direction or the tape length direction by this force. In this case, the fastener element may be held between the counterpart fastener elements in a leaned and unordinary position, for example. Therefore, there were possibilities that an opening and closing operation of the fastener elements by the slider is disturbed or, in a worst case, so-called chain breakage in which the fastener elements are forcibly decoupled occurs.

On the other hand, for example if the length of the tip end edge (short side) on the coupling head portion side in the base end surface is made to be short to avoid a problem of chain breakage and the like caused by bumping the left and right fastener elements as described above, and if the base end surface is formed to be a rectangle, the length of the tail end edge (short side) on the leg portion side in the base end surface becomes short similarly. In this case, in a slide fastener formed by using such fastener elements, an interval between the tail end parts (end parts on the leg portion side) of the base end surface of the fastener elements adjacent to each other and fixed to the fastener tape becomes wide.

Therefore, for example when the slider is slid and the left and right element rows are coupled in a state that the strong lateral pulling force pulling to an outside in the tape width direction is added to the left and right fastener tapes, a flange portion of the slider enters into the widened interval between the tail end parts of the adjacent fastener elements, and the fastener element becomes easy to get stuck into a tape penetrating gap of the slider, thereby a sliding operation in the slider closing direction can be disturbed.

In light of these informalities, the base end surface has a trapezoidal shape in which the lower base on the leg portion side is longer than the upper base on the coupling head portion side, thereby it becomes possible that, for example, the length of the upper base (the tip end edge on the coupling head portion side) of the base end surface is set to be short such that chain breakage and the like can be prevented even if a part of the slide fastener is bent strongly and partially by receiving the push-up force and the like, as well as the length of the lower base (the tail end edge on the leg portion side) of the base end surface is set to be long such that the flange portion of the slider can be prevented from entering (gets stuck) between the fastener elements even if the slider is slid in a closing direction in a state that the strong lateral pulling force is added to the slide fastener.

Thus, it can be prevented that the fastener element is held in a leaned and unordinary position and chain breakage occur even if the strong push-up force or the lateral pulling force is added, and also prevented that the sliding operation of the slider is disturbed by getting stuck between the fastener elements, thus a slide fastener with high quality and capable of maintaining a fastener function stably can be manufactured stably. Further, the base end surface is formed as a trapezoidal shape as described above, thereby the element width dimensions of the first and second bulging portions can be gradually increased toward the leg portion side, which enables to secure strength of the first and second bulging portions (particularly the end parts on the lower base sides of the first and second bulging portions) stably.

Particularly in this case, by setting the length of the lower base of the base end surface by 1.2 times or less of the length of the upper base, an effect obtained by making the above base end surface a trapezoidal shape can be secured and an appearance of the fastener element having a trapezoid-shaped base end surface can be closer to that of the single-sided metal element. Further in this case, since the length of the upper base of the base end surface becomes long to some extent, strength of the end part on the upper base side of the first and second bulging portions can be properly secured.

Further in this case, a pair of top and bottom side edges of the base end surface are formed as a curved line curving concavely toward an inside, thereby the base end surface of the trapezoid can be looked slimmer. Therefore, an appearance of the fastener element can be closer to that of the single-sided metal element. It should be noted that, in the present invention, a pair of top and bottom side edges of the base end surface may be formed as a straight line.

In the fastener element of the present invention, it is preferable that the tapered protrusion end surface declines from the base end surface in the element width direction and the quadrilateral (particularly trapezoidal)-shaped base end surface has a sloped surface declining toward the tip end edge on the coupling head portion side in the element length direction.

Thus, in the slide fastener formed by using the above-mentioned fastener element, when a part of the slide fastener is strongly bent in a direction in which the first bulging portions (or the second bulging portions) are close to each other by receiving the push-up force and the like in a coupling state of the fastener elements, the tip end part of the first bulging portion (or the second bulging portion) of one fastener element and the tip end part of the first bulging portion (or the second bulging portion) of the other fastener element of left and right element rows can hardly bump each other. Accordingly, it can be more effectively prevented that the fastener element is held in a leaned and unordinary position and chain breakage occurs.

Further, the tapered protrusion end surface declines as described above and the quadrilateral-shaped base end surface has a declined surface as described above, thereby sliding resistance of the slider with respect to the fastener element can be weakened when the slider of the slide fastener in the present invention slides. Moreover, for example when the slider slides in the closing direction, even if the position of the fastener element rotates a little in a direction to raise with respect to the slider by adding the lateral pulling force to the fastener tape, the fastener element can hardly get stuck with the slider. Accordingly, the slidability of the slider can be further enhanced.

Further in the fastener element of the present invention, the quadrilateral-shaped base end surface is disposed only in a region inside of the neck portion of the central land portion regarding the element width direction, and a maximum value of the dimension of the base surface in the element width direction is set to be smaller than a minimum value of the dimension of the neck portion of the central land portion in the element width dimension.

Thus, the fastener element can be looked slimmer and more stylish. Further, when the slide fastener is bent strongly and partially in a direction in which the first bulging portions (or the second bulging portions) of the fastener element come close to each other, chain breakage can be more effectively prevented.

Further, the quadrilateral-shaped base end surface is disposed only in a region inside of the neck portion of the central land portion, thereby a pair of top and bottom side wall surfaces disposed at the first and second bulging portions can be formed as sloped surfaces (flat surfaces or curved surfaces) declining obliquely from the bulging end surface toward a side surface of the central land portion. Accordingly, a draft in injection molding of the fastener element can be stably provided at a pair of top and bottom side wall surfaces of the first and second bulging portions, thereby demold in molding can be smooth.

Further, in the fastener element of the present invention, the tapered protrusion end surface is formed as a flat surface or a convex curved surface. On the other hand, at least a part disposed corresponding to the opposite side of the protrusion end surface out of the side wall surfaces across the base end surface declines toward the central land portion and is formed as a concave curved surface (concave surface).

The tapered protrusion end surface is formed as such a flat surface or a convex curved surface as above, thereby when the fastener element is viewed from a tape front and rear direction side, the quadrilateral-shaped base end surface as well as the tapered protrusion end surface can be seen easily. At the same time, the side wall surface disposed on the opposite side of the tapered protrusion end surface is formed in a concave shape, thereby when the side wall surface is viewed from the tape front and rear direction side, the side wall surface can hardly be seen, and since light reflected at the concave surface hardly scatters to the tape front and rear direction side, a visual effect that the side wall surface becomes a shadow part and is looked as dark can be obtained. As a result, the fastener element can be looked more similar to the single-sided metal element.

In the fastener element of the present invention, the central land portion has a shoulder portion extending from the neck portion in the element width direction and a concave groove portion concaved at the tip end part of the coupling head portion, and the central land portion is also formed in a front-rear symmetrical shape about a reference surface positioning at a center of the fastener tape in the tape thickness direction.

The central land portion is formed as above, thereby in forming the slide fastener, the left and right fastener elements can be coupled stably, and a strength with respect to the lateral pulling force in the tape width direction (lateral pulling strength) or a strength with respect to the push-up force in the tape front and rear direction (push-up strength) can be properly secured.

Further, the fastener element having the above-mentioned central land portion looks well, its appearance quality is excellent and the slidability of the slider is excellent since the slider can slide smoothly when the slide fastener is formed.

On the other hand, in the fastener element of the present invention, the central land portion may have a first half portion disposed on a tape front surface side of a reference surface positioned at a center of the fastener tape in the tape thickness direction and a second half portion disposed on a tape rear surface side of the reference surface, and also may be formed to be disposed in a displaced position each other in the element width direction.

Also by forming the central land portion as above, in forming the slide fastener, the left and right fastener elements can be coupled stably, and a strength with respect to the lateral pulling force in the tape width direction (lateral pulling strength) or a strength with respect to the push-up force in the tape front and rear direction (push-up strength) can be properly secured.

Since the fastener element having the above-mentioned central land portion has a form without an undercut when a mold for injection molding is opened in the tape front and rear direction, the fastener element can be injection molded easily.

In addition, by the present invention, a fastener stringer in which a plurality of fastener elements having the above-mentioned structure are fixed to the tape side edge parts of the fastener tape is provided, and further a slide fastener having such a pair of fastener stringers and a slider is provided.

By the slide fastener according to the present invention, each fastener element made of synthetic resin can be looked similar to the single-sided metal element, and also can be formed lighter than a slide fastener having the conventional single-sided metal elements. Further, in the slide fastener according to the present invention, even when two sliders of a first slider and a second slider are attached to element rows in an opposing direction to each other, it can be prevented that the operability of the slider is different in these two sliders, unlike the case of the slide fastener having the conventional single-sided metal element.

DESCRIPTION OF EMBODIMENT

Hereinafter, preferred embodiments of the present invention are described in detail with Embodiments referring to drawings. It should be noted that the present invention is not limited thereto, and various changes can be made as long as they have a substantially same structure and same functional effects.

Embodiment 1

Figure 1:
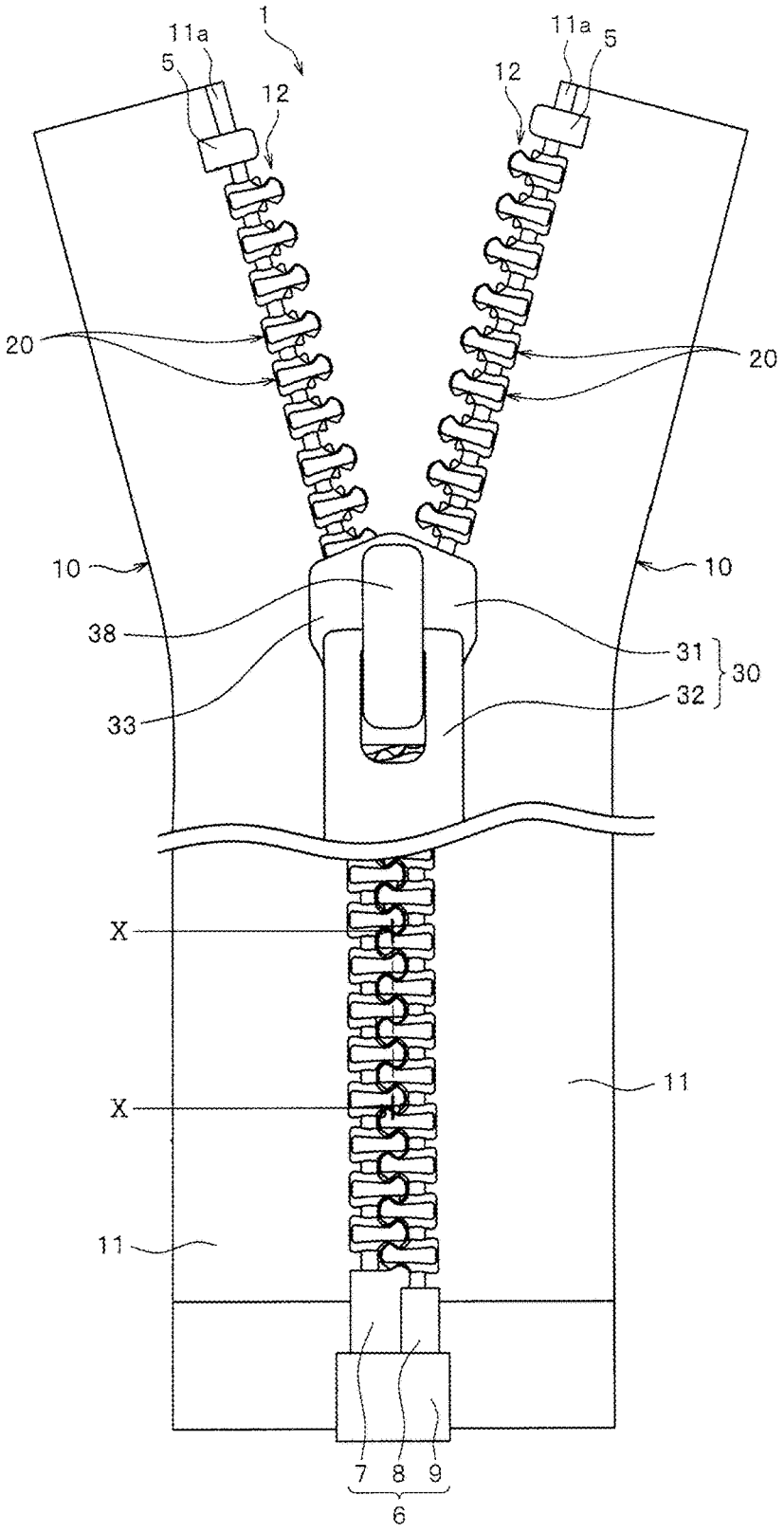
FIG. 1 is a plan view illustrating a slide fastener having fastener elements according to Embodiment 1 of the present invention.
Figure 2:
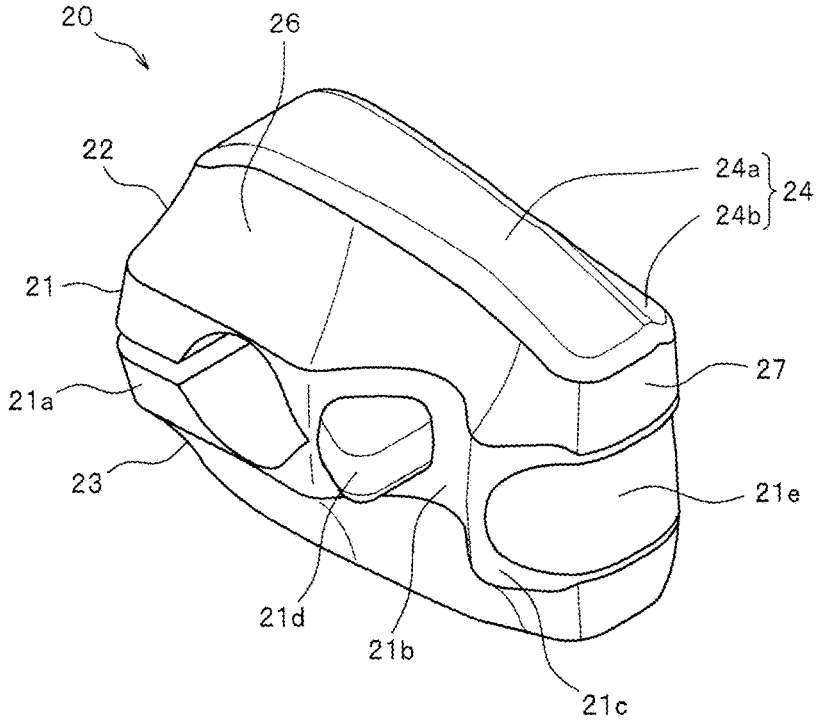
FIG. 2 is a perspective view illustrating the fastener element.
Figure 3:
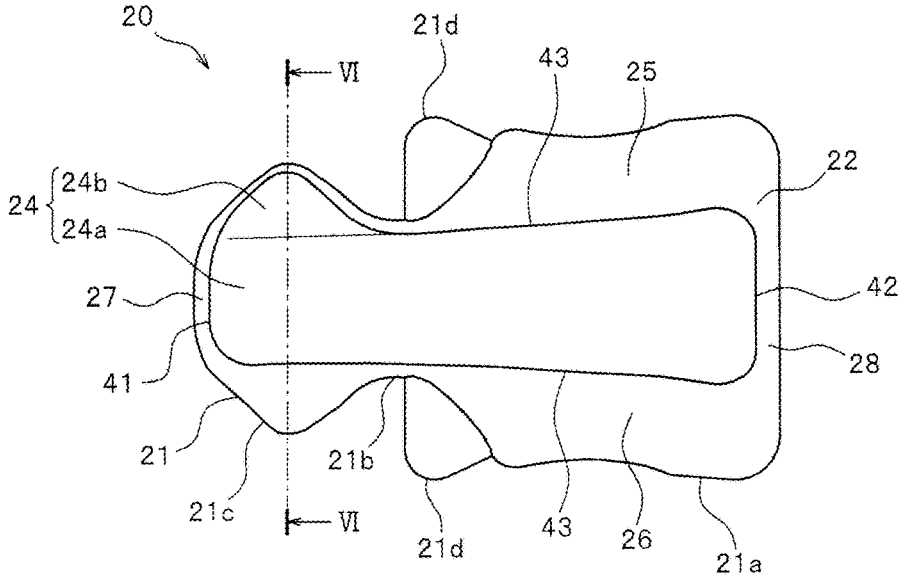
FIG. 3 is a plan view illustrating the fastener element.
Figure 4:
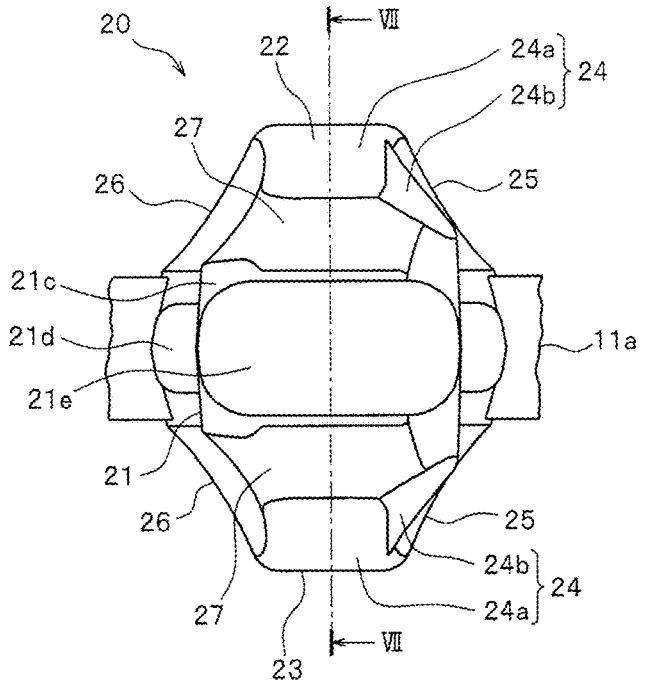
FIG. 4 is a schematic view viewing the fastener element from a coupling head portion side of a central land portion in a tape width direction.
Figure 5:
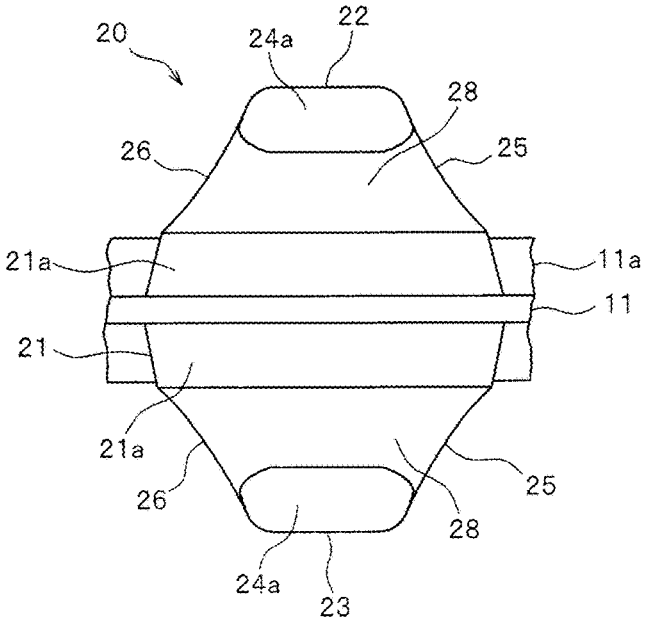
FIG. 5 is a schematic view viewing the fastener element from a leg side of the central land portion in the tape width direction.

FIG. 1 is a plan view illustrating a slide fastener having fastener elements according to Embodiment 1 of the present invention. FIG. 2 and FIG. 3 are a perspective view and a plan view illustrating the fastener element. FIG. 4 is a schematic view viewing the fastener element from a coupling head portion side of a central land portion in a tape width direction, and FIG. 5 is a schematic view viewing the fastener element from a leg side of the central land portion in the tape width direction.

It should be noted that, in the following explanation, a tape length direction of a fastener tape is prescribed as a top and bottom direction, particularly a direction in which a slider slides when the slide fastener is closed means top and a direction in which a slider slides when the slide fastener is opened means bottom. A tape width direction of the fastener tape is prescribed as a left and right direction. Further, a tape front and rear direction of the fastener tape is prescribed as an upper and lower direction, and a side at which a tab of the slider is disposed with respect to the fastener tape means upper and an opposite side means lower.

Further, regarding the fastener element, to explain characteristic structures of the present invention comprehensively, a tape length direction is described as an element width direction, a tape width direction is described as an element length direction and a tape front and rear direction is described as an element thickness direction.

The slide fastener 1 according to Embodiment 1 of the present invention has, as shown in FIG. 1, a pair of left and right fastener stringers 10 on which element rows 12 are formed along opposite tape side edge parts of left and right fastener tapes 11, first stops 5 (also referred to as upper stops) disposed adjacent to the element rows 12 at top end parts of each fastener stringer 10, a separable bottom end stop 6 disposed at bottom end parts of the pair of fastener stringers 10, and a slider 30 disposed slidably along the element rows 12.

It should be noted that the slide fastener 1 of Embodiment 1 has main characteristics in a shape of each fastener element 20 forming the element rows 12, and the fastener tape 11, the first stop 5, the separable bottom end stop 6, and the slider 30 which are substantially the same as a general slide fastener having the conventional fastener elements made of synthetic resin are used.

For example, the separable bottom end stop 6 of Embodiment 1 has an insert pin 7 disposed at a bottom end part of the left fastener stringer 10, a box pin 8 disposed at a bottom end part of the right fastener stringer 10, and a box 9 molded integrally to a bottom end part of the box pin 8, and is formed for right-side insertion.

It should be noted that, in the present invention, it is possible that a position relationship between, for example, the insert pin 7, the box pin 8 and the box 9 are inverted in the left and right direction with respect to Embodiment 1, that is, the insert pin 7 is attached to the left fastener stringer 10 and the box pin 8 and the box 9 are attached to the left fastener stringer 10, thereby the separable bottom end stop 6 for left side insertion is formed.

The slider 30 of Embodiment 1 has a slider body 31 and a tab 32 with an attaching axis portion at one end part, and the tab 32 is held at the slider body 31 so as to be rotatable at the attaching axis portion. The slider body 31 has an upper blade plate 33 and a lower blade plate 34, a guide post 35 connecting top end parts of the upper blade plate 33 and the lower blade plate 34, upper flange portions 36 standing vertically at the left and right side edge parts of the upper blade plate 33, lower flange portions 37 standing at the left and right side edge parts of the lower blade plate 34, and a tab attaching post 38 provided on an upper surface of the upper blade plate 33.

Left and right shoulder openings are formed at a top end of the slider body 31 interposing the guide post 35, and a bottom opening is formed at a bottom end of the slider body 31. Further, an approximately Y-shaped element guide pass which connects the left and right shoulder openings and the bottom opening is formed between the upper blade plate 33 and the lower blade plate 34.

In addition, a tape penetrating gap capable of inserting the fastener tape 11 is formed between the upper flange portions 36 and the lower flange portions 37 disposed at the left and right side parts of the slider body 31. In this case, a width dimension t1 between an inner side surface and an outer side surface of the upper flange portion 36 and a width dimension t2 between an inner side surface and an outer side surface of the lower flange portion 37 are set to be the same size.

In each fastener stringer 10 of Embodiment 1, the fastener tape 11 is woven or knitted as a narrow band shape which is long in the tape length direction. Each fastener tape 11 has a tape main body part sewn to a fastener attached product (cloths or bags) and a tape side edge part (element attaching part) at which the element rows 12 are formed.

Core string portions 11*a* are disposed at tape side edges facing each other of the left and right fastener tapes 11. Each element row 12 is formed by fixing a plurality of fastener elements 20 made of synthetic resin to the tape side edge part including the core string portion 11*a* of the fastener tape 11 at a constant interval in the tape length direction.

In this case, the fastener element 20, the first stop 5 and the separable bottom end stop 6 are formed by injection molding, for example, thermoplastic resin such as nylon, polyacetal, polyamide, polypropylene, polybutylene-terephthalate, polycarbonate and the like or composite materials in which reinforced fiber such as glass fiber, carbon fiber, aramid fiber and the like is included in the above thermoplastic resin to the fastener tape 11.

The fastener element 20 formed by using the above-mentioned thermoplastic resin is substantially lighter than the conventional single-sided metal element (single-sided fastener element made of metal). Particularly the fastener element 20 of Embodiment 1 is formed by injection-molding a material in which glass fiber is mixed in nylon to the fastener tape 11, thereby stiffness of the fastener element 20 is enhanced.

In Embodiment 1, it is possible that metal glazing is provided to a bulging end surface 24 (a trapezoid-shaped base end surface 24*a* and a tapered protrusion end surface 24*b*) having a shape similar to the single-sided metal element of the fastener element 20 by transcribing metal foil into the bulging end surface 24 of the fastener element 20 as described later by transcription printing and the like.

Each fastener element 20 of Embodiment 1 has a central land portion 21 disposed at a center part in the element thickness direction, a first bulging portion (front surface side bulging portion) 22 bulging from the central land portion 21 to an upper side and a second bulging portion (rear surface side bulging portion) 23 bulging from the central land portion 21 to a lower side, and the first bulging portion 22 and the second bulging portion 23 are formed in a front-rear symmetrical shape about a reference surface positioning at a center of the fastener tape 11 in the tape thickness direction.

In this case, the first bulging portion 22 of the fastener element 20 becomes an exposed surface side exposing to an outside in the slide fastener 1. An element thickness dimension from an upper surface (a bulging end surface 24 described later) of the first bulging portion 22 to a lower surface (a bulging end surface 24 described later) of the second bulging portion 23 of the fastener element 20 in a tape front and rear direction is set to be a predetermined size corresponding to a size of an interval between the upper and lower blade plates 33, 43 of the slider 30.

The central land portion 21 of Embodiment 1 has a body portion 21*a* fixed to a tape side edge part of the fastener tape 11, a neck portion 21*b* extending from the body portion 21*a* to a tape outward in a tape width direction (an element length direction), a coupling head portion 21*c* further extending from the neck portion 21*b* in the tape width direction, a pair of top and bottom shoulder portions 21*d* protruding from the neck portion 21*b* in a tape length direction (an element width direction) and a concave groove portion 21*e* concaved at a tip end part of the coupling head portion 21*c*.

The body portion 21*a* of the central land portion 21 is fixed over a tape front surface and a tape rear surface of the fastener tape 11. In this case, an area in which the body portion 21*a* is fixed to the fastener tape 11 is approximately the same size as that in which, for example, a conventional and general fastener element made of synthetic resin is fixed to a fastener tape so as to secure fixing strength to the fastener tape 11.

It should be noted that, in the body portion 21*a* of the central land portion 21, if enough fixing strength to the fastener tape 11 can be obtained, the element width dimension of the body portion 21*a* can be set to be smaller than the conventional one, for example. If necessary, the element width dimension of the body portion 21*a* can be larger than the conventional one.

The neck portion 21*b* of the central land portion 21 extends from the tape side edge of the fastener tape 11 to a tape outward, and has a constricted form so as a dimension in the element width direction to be smaller than those of the coupling head portion 21*c* and the body portion 21*a* to be able to hook the coupling head portion 21*c* of the counterpart fastener element 20.

The shoulder portions 21*d* of the central land portion 21 extend from a center part of the neck portion 21*b* in the element thickness direction to a top and bottom direction along the element width direction. These shoulder portions 21*d* are formed so as to be able to be inserted into the concave groove portion 21*e* formed at the counterpart coupling head portion 21*c* when the coupling head portion 21*c* of the counterpart fastener element 20 is fitted to the neck portion 21*b* of the central land portion 21.

The coupling head portion 21*c* of the central land portion 21 further extends from the neck portion 21*b* to a tape outward and is formed in an oblong shape bulging in the element width direction. A concave groove portion 21*e* is formed at a tip end part of the coupling head portion 21*c* with a size capable of inserting the shoulder portion 21*d* of the counterpart fastener element 20 along the element width direction (the tape length direction).

The central land portion 21 has the above-mentioned shape, thereby when the slide fastener 1 is opened and closed by sliding the slider 30, the left and right fastener elements 20 can be smoothly coupled and separated, and when the left and right fastener elements 20 are engaged, enough coupling strength to endure use of the slide fastener 1 can be stably obtained.

Further, since such a central land portion 21 is formed in a top-bottom symmetrical shape about a reference surface positioning at a center in the element width direction, it looks well, its appearance quality is excellent, and the coupling and separating operation of the left and right fastener elements 20 by sliding the slider 30 can be smooth, therefore the slidability of the slider 30 is also good.

In addition, for example in a case of forming a slide fastener by attaching two sliders of a first slider (forward slider) and a second slider (reverse slider) to the element rows 12 so as respective bottom openings to oppose to each other, informality that the difference of the operability in two sliders which was a problem in a slide fastener having the conventional single-sided metal element does not occur.

The first bulging portion 22 and the second bulging portion 23 of the fastener element 20 in Embodiment 1 are formed in a front-rear symmetrical shape about a reference surface positioned at a center of the fastener tape 11 in the tape thickness direction, as described above. Accordingly, the first bulging portion 22 is explained in detail here and the detailed explanation of the second bulging portion 23 is omitted.

The first bulging portion 22 of Embodiment 1 is formed integrally to the central land portion 21 as a first design part of the fastener element 20, and has a stereoscopic shape bulging from the central land portion 21 upward. The first bulging portion 22 has an bulging end surface 24 facing upward as an upper surface, a top side wall surface 25 and a bottom side wall surface 26 facing to the element width direction, a tip end surface 27 facing to a counterpart engagement side and a tail end surface 28 facing to a tape inward side of the fastener tape 11. Respective surfaces 24-28 are comparted by edge line portions.

Here, the bulging end surface 24 of the first bulging portion 22 means an end surface whose sloped angle (sloped angle on an inner angle side) with respect to a tape surface of the fastener tape 11 is 45° or smaller. The bulging end surface 24 is formed with the sloped angle of 45° or smaller with respect to a tape surface, thereby when the fastener element 20 is viewed from the upper surface side (see FIG. 3), the shape or the outline of the bulging end surface 24 can be clearer. Further, for example when the metal foil is transcribed to the bulging end surface 24 of the fastener element 20 by transcription printing as described above, the transcription can be made tidily and stably.

The bulging end surface 24 of the first bulging portion 22 has a base end surface 24*a* appearing a trapezoid which is long in the element length direction and a protrusion end surface 24*b* protruding as a tapered triangular shape from an end part of the base end surface 24*a* on the coupling head portion 21*c* side to a top direction in viewing the fastener element 20 from the upper surface side. The bulging end surface 24 has such a shape, thereby in viewing the fastener element 20 made of synthetic resin from a tape front and rear direction side of the fastener tape 11, the first bulging portion 22 and the second bulging portion 23 can appear similar to the single-sided metal element.

Particularly in Embodiment 1, the trapezoid-shaped base end surface 24*a* has a tip end edge on the coupling head portion 21*c* side as an upper base 41, a tail end edge on the leg portion side as a lower base 42, and a pair of top and bottom side edges as a pair of oblique sides (legs) 43, and also has an isosceles trapezoidal shape in which the lower base 42 is formed longer than the upper base 41.

It should be noted that, in the fastener element 20 of the present invention, it is enough for the base end surface 24*a* of the bulging end surface 24 to have a quadrilateral shape in which four sides made of a straight or a curved line are connected at four tip points when viewing from a front and rear direction, and instead of a trapezoidal shape which is long in the element length direction as described above, it may have a rectangular shape which is long in the element length direction, for example.

In this case, the length of the lower base 42 of the base end surface 24*a* is set to be longer than the upper base 41. Further, an interval d between the tail end parts (lower base side end parts) at the base end surface 24*a* of adjacent fastener elements 20 on the same fastener tape 11 in the tape length direction is set to be larger than the width dimension t1 of the above-mentioned upper flange portion 36 of the slider 30. It should be noted that, also in the case of the second bulging portion 23, the interval d in the fastener element 20 is set to be larger than the width dimension t2 of the lower flange portion 37 of the slider 30.

The length of the lower base 42 of the base end surface 24*a* is made to be long and the interval d between the fastener elements 20 is made to be small as above, thereby even if, for example, the slider 30 slides to a top direction (in closing direction) in a state that the strong lateral pulling force is added to the slide fastener 1, it can be prevented that the upper and lower flange portions 36, 37 of the slider 30 enter and stop between the fastener elements 20.

Further in this case, in the base end surface 24*a* of Embodiment 1, the length of the lower base 42 is set to be 1.2 times or less of that of the upper base 41, and a pair of top and bottom oblique sides 43 are formed as a curved line which curves concavely toward an inside.

Thus, even if the base end surface 24*a* is formed as a trapezoidal shape so as to prevent the slider 30 from entering between the fastener elements 20 as described above, the shape of the base end surface 24*a* can be close to a rectangle and look slimmer. In fact, the base end surface 24*a* of Embodiment 1 is formed slim so as to be disposed only in a region inside of the neck portion 21*b* of the central land portion 21 in the element width direction.

Therefore, an appearance of the fastener element 20 viewing from the tape front and rear direction side can be closer to that of the single-sided metal element. In this case, since the length of the upper base 41 of the base end surface 24*a* is formed long to some extent, the strength of the end parts on the upper base 41 side of the first and second bulging portions 22, 23 can be properly secured. It should be noted that a pair of top and bottom oblique sides 43 of the base end surface 24*a* may be formed of straight lines, not of curved lines as above.

Also as described above, the trapezoid-shaped base end surface 24*a* is disposed only in the region inside of the neck portion 21*b* of the central land portion 21, and a maximum value of a dimension of the base end surface 24*a* in the element width direction is set to be smaller than a minimum value of a dimension of the neck portion 21*b* of the central land portion 21 in the element width direction.

Thus, in viewing the fastener element 20 from the upper side (see FIG. 3), a pair of top and bottom oblique sides 43 of the trapezoid-shaped base end surface 24*a* are disposed at a position inside of the top and bottom side surfaces of the central land portion 21 in the element width direction. That is, a position of the top and bottom oblique sides 43 of the base end surface 24*a* and a position of the top and bottom side surfaces of the central land portion 21 (particularly, the top and bottom side surfaces of the leg portion and the coupling head portion 21*c* of the central land portion 21) move away from each other.

The top and bottom oblique sides 43 of the base end surface 24*a* and the top and bottom side surfaces of the central land portion 21 are apart in viewing from the upper side, thereby the top and bottom side wall surfaces 25, 26 of the first bulging portion 22 can be declined obliquely from the bulging end surface 24 toward a side surface of the central land portion 21. Accordingly, the draft in injection molding of the fastener element 20 can be stably provided at the pair of top and bottom side wall surfaces 25, 26 and demold in molding can be performed smoothly.

Figure 7:
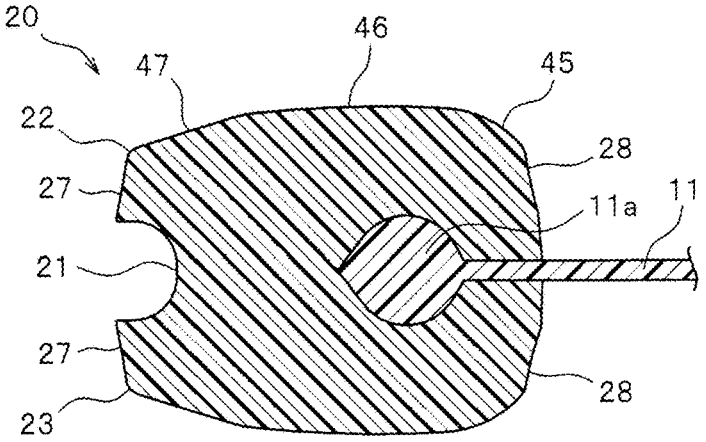
FIG. 7 is a cross-sectional view in VII-VII line shown in FIG. 4.
Figure 8:
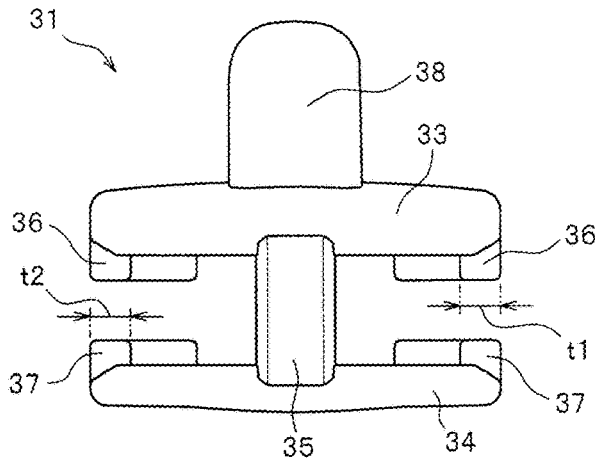
FIG. 8 is a front view illustrating a slider used to a slide fastener.

The trapezoid-shaped base end surface 24*a* has, as shown in FIG. 7, a tail end side curved surface 45 curving convexly so as to incline from the lower base 42 (tail end edge) toward the upper base 41 (tip end edge) side in the tape width direction, a main base end surface 46 which is formed continuously from the curved surface 45 and is approximately parallel to the tape surface of the fastener tape 11 or curves in a slightly convex shape and a declined surface 47 which is formed continuously from the main base end surface 46 and declining in a flat surface shape so as to decrease gradually the element thickness dimension toward the upper base 41 (tip end edge) in the tape width direction.

In this case, the tail end side curved surface 45, the main base end surface 46 and the declined surface 47 of the base end surface 24*a* are formed in parallel to the tape length direction of the fastener tape 11 respectively. A sloped angle with respect to the tape surface of the fastener tape 11 in the declined surface 47 of the base end surface 24*a* is set to be from 5° to 30° inclusive.

The base end surface 24*a* of Embodiment 1 has the above-mentioned declined surface 47, thereby even if a part of the slide fastener 1 is bent strongly and partially in the tape front and rear direction by receiving the push-up force and the like as described above, the fastener element 20 having the base end surface 24*a* and the counterpart fastener element 20 can hardly bump, and even if the fastener elements 20 bump, the force in a direction in which the fastener elements 20 are disengaged can hardly work. Accordingly, chain breakage can be effectively prevented.

The tip end part of the base end surface 24*a* on the coupling head portion 21*c* side declines as described above, thereby even if, for example, the slide fastener 1 receives the lateral pulling force and the like when sliding the slider 30 in the closing direction, it can be prevented that the fastener element 20 gets stuck with the slider 30 and interferes the sliding operation of the slider 30. Thus, the good slidability of the slider 30 can be stably maintained.

The protrusion end surface 24*b* of the first bulging portion 22 protrudes from only a part of the side edge on a top side out of a pair of top and bottom side edges of the base end surface 24*a* to a top direction and is formed on a region of the coupling head portion 21*c*. In addition, the protrusion end surface 24*b* protrudes so as to be a tapered shape in which the dimension in the element length direction gradually decreases to a top direction. That is, the protrusion end surface 24*b* has an approximately triangular shape corresponding to a side edge shape from the coupling head portion 21*c* to the neck portion 21*b* in viewing the protrusion end surface 24*b* from the tape front and rear direction side. It should be noted that, in the present invention, the first bulging portion 22 may be formed, for example, so as the protrusion end surface 24*b* to protrude from only a part of the side edge on the bottom side of the base end surface 24*a* to a bottom direction.

In this case, in the triangular-shaped protrusion end surface 24*b*, a longest side of the protrusion end surface 24*b* extending in the tape width direction overlaps with the oblique side 43 of the trapezoid-shaped base end surface 24*a*. A side on an element tip end side out of two sides extending obliquely from the base end surface 24*a* of the protrusion end surface 24*b* to a top direction is formed continuously to the upper base 41 of the trapezoid-shaped base end surface 24*a*.

Figure 6:
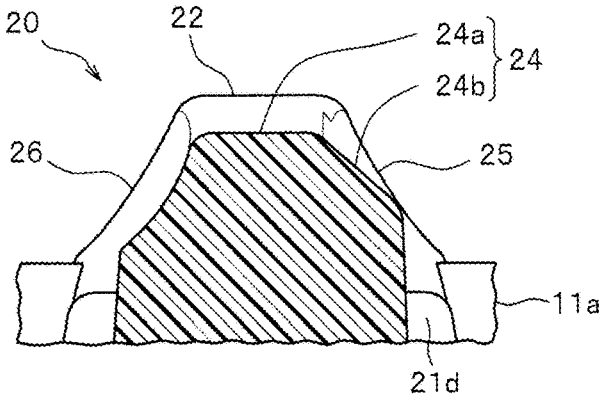
FIG. 6 is a cross-sectional view of a tape top surface side in VI-VI line shown in FIG. 3.

The protrusion end surface 24*b* is formed, as shown in FIG. 6, as a flat sloped surface which declines so as the element thickness dimension to gradually decrease from the base end surface 24*a* via a edge line portion to a top direction with respect to the trapezoid-shaped base end surface 24*a* parallel to the tape length direction. In this case, the protrusion end surface 24*b* slopes with respect to the base end surface 24*a* or the tape surface of the fastener tape 11. It is preferable that a sloped angle (a sloped angle on an inner angle side) of the protrusion end surface 24*b* with respect to the tape surface of the fastener tape 11 is set to be 45° or smaller, particularly from 20° to 45° inclusive. Particularly in Embodiment 1, the protrusion end surface 24*b* declines from the base end surface 24*a* to a top direction in the tape length direction so as the sloped angle with respect of the tape surface of the fastener tape 11 to be 40°.

The protrusion end surface 24*b* of Embodiment 1 declines with respect to the base end surface 24*a* or the tape surface of the fastener tape 11 as described above, thereby even if a part of the slide fastener 1 is bent strongly and partially in the tape front and rear direction, it can be effectively prevented that the fastener element is held in a leaned and unordinary position or chain breakage occurs, as described later.

Further, the protrusion end surface 24*b* is formed as a flat surface, not as a concave surface, thereby when viewing the fastener element 20 from the upper side, the triangular-shaped protrusion end surface 24*b* of the first bulging portion 22 can be formed to be looked as the trapezoid-shaped base end surface 24*a* easily, and light can be easily reflected at the protrusion end surface 24*b* to the tape front and rear direction side. Therefore, the shape of the bulging end surface 24 formed of the base end surface 24*a* and the protrusion end surface 24*b* can be looked tidily as the single-sided metal element.

A top side wall surface 25 and a bottom side wall surface 26 of the first bulging portion 22 are disposed from the bulging end surface 24 to a side surface of the central land portion 21 so as to face to the tape length direction, and edge line portions are formed at a boundary part of the bulging end surface 24 and a boundary part of the central land portion 21 respectively.

Particularly in this case, the top side wall surface 25 is formed to decline to a top direction from a side edge of the triangular-shaped protrusion end surface 24*b* and a part excluding the tip end part connecting to the protrusion end surface 24*b* out of the top oblique side 43 of the trapezoid-shaped base end surface 24*a* toward the central land portion 21.

The bottom side wall surface 26 is formed to decline to a bottom direction from the bottom oblique side 43 of the trapezoid-shaped base end surface 24*a* toward the central land portion 21. The declined surfaces (tapered surfaces) of such top and bottom side wall surfaces 25, 26 are formed so as the sloped angle with respect to the tape surface of the fastener tape 11 to be larger than 45°, and function as a draft in injection molding of the fastener element 20 as described above.

The top side wall surface 25 and the bottom side wall surface 26 of the first bulging portion 22 has a curved surface (concave surface) curving in a concave shape so as to concave to an inward of the fastener element 20. The top side wall surface 25 and the bottom side wall surface 26 of the first bulging portion 22 are formed in the above-mentioned concave surface shape, thereby when viewing the first bulging portion 22 from the upper surface side, the top side wall surface 25 and the bottom side wall surface 26 are hardly looked.

Moreover, reflection direction of light is changed by the concave surfaces disposed at the top side wall surface 25 and the bottom side wall surface 26, and light hardly scatters to the element upper side at the top side wall surface 25 and the bottom side wall surface 26 of the first bulging portion 22. As a result, the top side wall surface 25 and the bottom side wall surface 26 of the first bulging portion 22 become as a shadow and looks darker than the bulging end surface 24.

Therefore, in the fastener element 20 of Embodiment 1, the trapezoid-shaped base end surface 24*a* of the bulging end surface 24 in the first bulging portion 22 looks bright and slim by a contrast between the top side wall surface 25 and the bottom side wall surface 26. Further, the sloped angle of the protrusion end surface 24*b* is made to be smaller than that of the bottom side wall surface 26 which is on an opposite side of the protrusion end surface 24*b* at the tip end part of the base end surface 24*a*, thereby the protrusion end surface 24*b* can be looked easily. In addition, the bottom side wall surface 26 which is on the opposite side of the above-mentioned protrusion end surface 24*b* is made to be concave surface-shaped and looked dark, thereby an existence of the protrusion end surface 24*b* can be identified clearly and stood out. As a result, the bulging end surface 24 of the first bulging portion 22 can be looked as the single-sided metal element more effectively.

It should be noted that, in Embodiment 1, the neck portion 21*b* of the central land portion 21 has a shape constricted narrowly in the element width direction, and a position of the top and bottom oblique sides 43 of the base end surface 24*a* and a position of the top and bottom side surfaces of the neck portion 21*b* from the upper view are disposed closely. Further, the triangular-shaped protrusion end surface 24*b* protrudes from the base end surface 24*a* to a top direction to almost the top side surface of the coupling head portion 21*c*, and a position of a protrusion tip end edge of the protrusion end surface 24*b* and a position of the top side surface of the coupling head portion 21*c* from the upper view are disposed closely. Therefore, each wall surface of the side wall portions of such narrow top side wall portion, bottom side wall portion, and protrusion end surface 24*b* is formed in a concave-shaped curved surface with a small curvature or close to a flat surface, or as a flat surface in which the sloped angle with respect to the tape surface of the fastener tape 11 is close to 90° in some cases.

The second bulging portion 23 of the fastener element 20 in Embodiment 1 has a front-rear symmetrical shape about a reference surface positioned at a center of the fastener tape 11 in the tape thickness direction with respect to the first bulging portion 22, as described above. The first bulging portion 22 and the second bulging portion 23 are formed as plane-symmetrical with reference to the fastener tape 11 as above, thereby the slide fastener 1 can be structured so as the second bulging portion 23 to be on an exposed surface side which is exposed to an outside.

In the slide fastener 1 of Embodiment 1, since the fastener element 20 made of synthetic resin has the bulging end surface 24 formed of the trapezoid-shaped base end surface 24*a* and the triangular-shaped protrusion end surface 24*b* as described above, when viewing the fastener element 20 from the tape front and rear direction side, it shows an appearance close to the conventional single-sided metal element.

Accordingly, since the slide fastener 1 of Embodiment 1 can provide a stylish or a fashionable impression as if each fastener element 20 is the single-sided metal element which is slim in the tape width direction, it is excellent in its appearance quality and the design and lighter than the conventional slide fastener having the single-sided metal elements.

Figure 9:
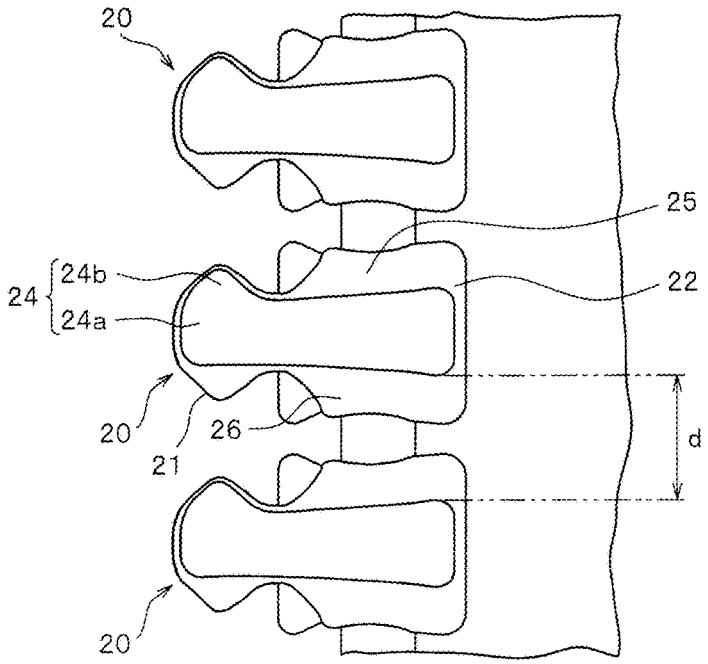
FIG. 9 is a main part enlarged view illustrating a part of a fastener stringer.

Although each fastener element 20 has a slim appearance in the tape width direction as the single-sided metal element, the interval d between the tail end parts at the base end surface 24*a* of adjacent fastener elements 20 in the tape length direction can be small (see FIG. 9) by forming each base end surface 24*a* in a trapezoidal shape. Therefore, for example, even if the slider 30 is slid in the closing direction in a state that the strong lateral pulling force is added to the slide fastener 1, the flange portion of the slider 30 can be prevented from entering between the fastener elements 20, and the smooth sliding operation of the slider 30 can be stably secured.

Further, the slide fastener 1 of Embodiment 1 has, as described above, the declined surfaces 47 declining toward the upper base 41 on at least the coupling head portions 21*c* out of the base end surfaces 24*a* of the first bulging portion 22 and the second bulging portion 23 of the fastener element 20, and the protrusion end surfaces 24*b* of the first bulging portion 22 and the second bulging portion 23 are formed by declining from the base end surface 24*a* to a top direction.

Figure 10:
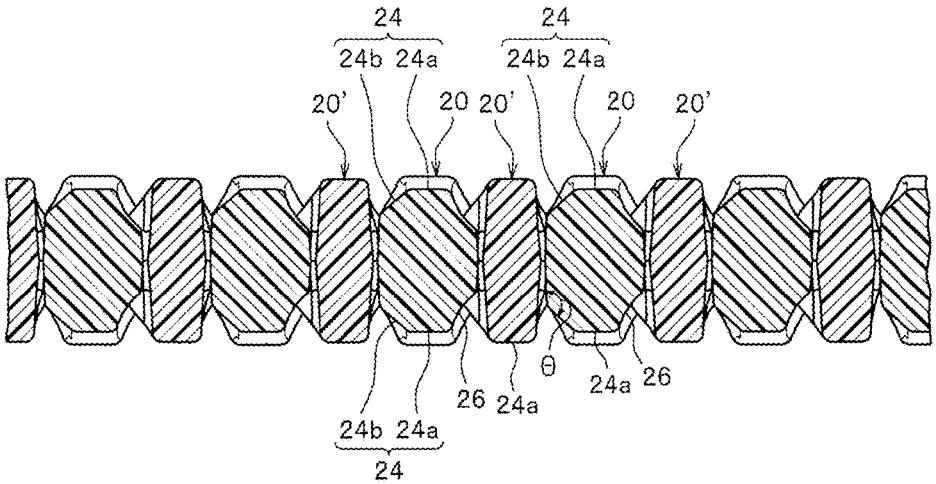
FIG. 10 is a cross-sectional view in X-X line shown in FIG. 1.

Thus, for example shown in FIG. 10, in a state of coupling each fastener element 20 fixed to the left and right fastener tapes 11, height positions of the tip end parts of the first and second bulging portions 22, 23 of each fastener element 20 from the fastener tape 11 can be lower than that of a part corresponding to the neck portions 21*b* of the first and second bulging portions 22, 23 of the counterpart fastener element 20'. It should be noted that, in FIGS. 10 and 11, for plain explanation about the engagement of the fastener elements 20, one fastener element out of the left and right fastener elements 20 is described by a reference sign "20" and the other counterpart fastener element is described by a reference sign "20".

Intervals between the protrusion end surfaces 24*b* of the first and second bulging portions 22, 23 of the fastener element 20 and the opposite bottom side wall surfaces 26 of the first and second bulging portions 22, 23 of the counterpart fastener element 20' can be increased with distance from the fastener tape 11. Further in this case, an angle θ formed by the protrusion end surface 24*b* of the first and second bulging portions 22, 23 and the top side wall surfaces 25 of the first and second bulging portions 22, 23 can be secured to be large.

As a result, when the slide fastener 1 of Embodiment 1 is, for example as shown in FIG. 10, bent partially to have a small curvature radius in a direction in which the second bulging portions 23 of the fastener elements 20, 20' come close to each other by receiving the push-up force and the like in a state that the left and right fastener elements 20, 20' are engaged, informalities such as chain breakage and the like can hardly occur. Such an effect is specifically explained as follows.

Here, for example, a case is assumed that the declined surfaces 47 are not provided at the tip end parts of the base end surfaces 24*a* of the first bulging portion 22 and the second bulging portion 23, and the protrusion end surfaces 24*b* protrude from and parallel to the base end surface 24*a* (at this time, the angle θ formed by the protrusion end surfaces 24*b* of the first and second bulging portions 22, 23 and the top side wall surfaces 25 of the first and second bulging portions 22, 23 is smaller than in the case of Embodiment 1).

Figure 11:
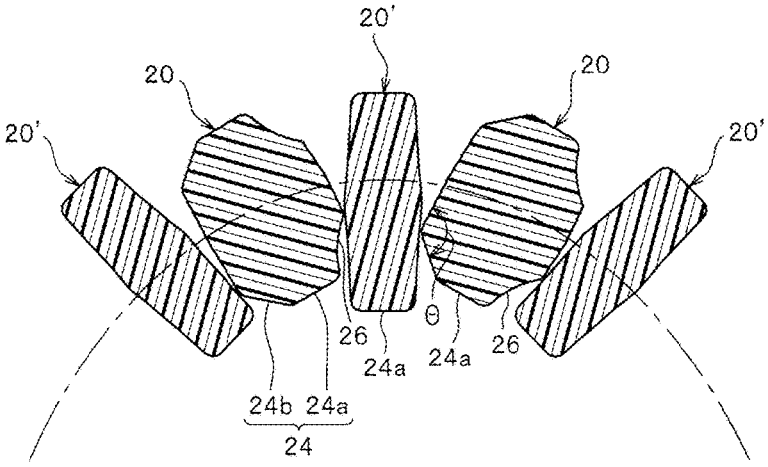
FIG. 11 is a cross-sectional view illustrating a state that a slide fastener in which left and right fastener elements are engaged is bent in a tape front and rear direction.

In this case, when the slide fastener 1 is bent partially in the direction in which the second bulging portions 23 of the left and right fastener elements 20, 20' come close to each other by receiving the push-up force and the like, and before the slide fastener 1 is bent to have a small curvature radius as shown in FIG. 11, the second bulging portion 23 of the fastener element 20 and the second bulging portion 23 of the counterpart fastener element 20' bump and interfere with each other. After that, when the slide fastener 1 is bent to have a small curvature radius as shown in FIG. 11, the left and right fastener elements 20, 20' (particularly the central land portion 21) turn in a direction in which they move away from each other at a part of interference between the fastener elements 20, 20' which becomes a fulcrum point, and the positions of the fastener elements 20, 20' lean in the tape front and rear direction or the tape length direction in some cases. As a result, there were problems that, for example, the fastener element 20' is hooked between the counterpart fastener elements 20 in a leaned and unordinary state and does not return to the ordinary state, then disturbing the sliding operation of the slider 30, and in a worst case, the central land portions 20 of the left and right fastener elements 20, 20' are disengaged and chain breakage occurs.

In contrast, in the slide fastener 1 of Embodiment 1, by providing the declination of the tip end part of the base end surface 24*a* and the declination of the protrusion end surface 24*b*, the height position at the tip end part of the second bulging portion 23 of the fastener element 20 from the fastener tape 11 can be low and the interval between the protrusion end surface 24*b* of the second bulging portion 23 and the counterpart fastener element 20' can be widely secured as described above. At the same time, the angle θ formed by the protrusion end surfaces 24*b* of the first and second bulging portions 22, 23 and the top side wall surfaces 25 of the first and second bulging portions 22, 23 can be large.

Thus, when the slide fastener 1 is bent partially to have a small curvature radius, the second bulging portion 23 of the counterpart fastener element 20 and the second bulging portion 23 of the fastener element 20' can hardly bump. Further, as shown in FIG. 11, even if the second bulging portion 23 of the fastener element 20 and the second bulging portion 23 of the counterpart fastener element 20' bump, the force with which the second bulging portion 23 of the fastener element 20 pushes the counterpart fastener element 20' in a disengagement direction can hardly work, and the significant lean of the fastener element 20' can be suppressed.

Therefore, the coupling status of the left and right fastener elements 20, 20' can be stably maintained by preventing the fastener element 20' from being held in an unordinary position as described above, and chain breakage can be effectively prevented. Accordingly, the slide fastener 1 becomes a high-quality one in which chain breakage of the slide fastener 1 of Embodiment 1 hardly occurs and fastener function can be stably maintained.

Figure 12:
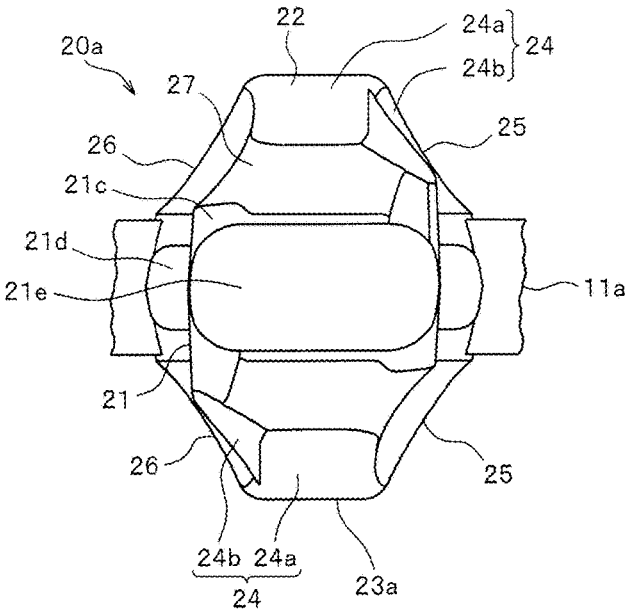
FIG. 12 is a schematic view viewing a fastener element according to a modification example of Embodiment 1 from the coupling head portion side of the central land portion in the tape width direction.

It should be noted that the first bulging portion 22 and the second bulging portion 23 of the fastener element 20 of Embodiment 1 are formed, as described above, front-rear symmetrically about a reference surface positioned at a center of the fastener tape 11 in the tape thickness direction. However, the fastener element of the present invention is not limited thereto, and for example as shown in FIG. 12 illustrating a fastener element 20*a* according to a modification example of Embodiment 1, the first bulging portion 22 and the second bulging portion 23*a* may be formed asymmetrically in the tape front and rear direction as long as each bulging end surface 24 of the first and second bulging portions 22, 23*a* has a quadrilateral-shaped base end surface 24*a* and a triangular-shaped protrusion end surface 24*b* respectively.

In the fastener element 20*a* according to the modification example, the second bulging portion 23*a* is formed to have a top-bottom reversed shape with respect to the second bulging portion 23 of the fastener element 20 according to the above-mentioned Embodiment 1 about a reference surface positioned at a center in the element length direction (the tape width direction) along the element width direction. In this case, the central land portion 21 and the first bulging portion 22 according to the modification example are formed the same as the central land portion 21 and the first bulging portion 22 of the fastener element 20 according to the above-mentioned Embodiment 1.

That is, the second bulging portion 23*a* of the modification example is formed symmetrically in an upper and lower direction (a tape front and rear direction) about a reference surface positioned at a center of the fastener tape 11 in the tape thickness direction, as well as is formed symmetrically in the top and bottom direction (the tape length direction) about a reference surface positioned at a center in the tape length direction.

From even the slide fastener in which a plurality of fastener elements 20*a* having such a shape according to the modification example are fixed to the tape side edge parts of the fastener tape 11, the same effect as in the slide fastener 1 according to the above-mentioned Embodiment 1 can be obtained.

Embodiment 2

Figure 13:
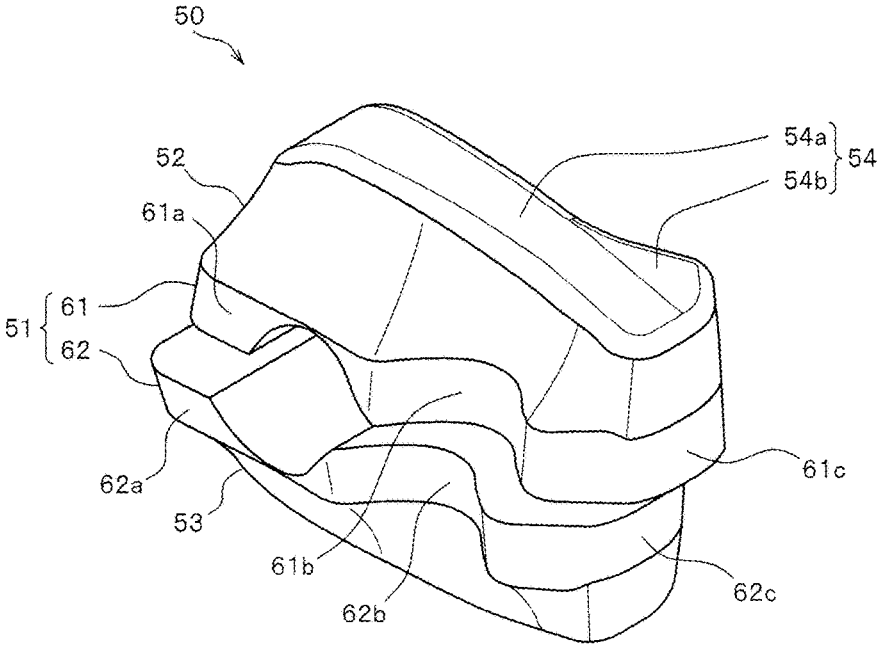
FIG. 13 is a perspective view illustrating a fastener element according to Embodiment 2 of the present invention.
Figure 14:
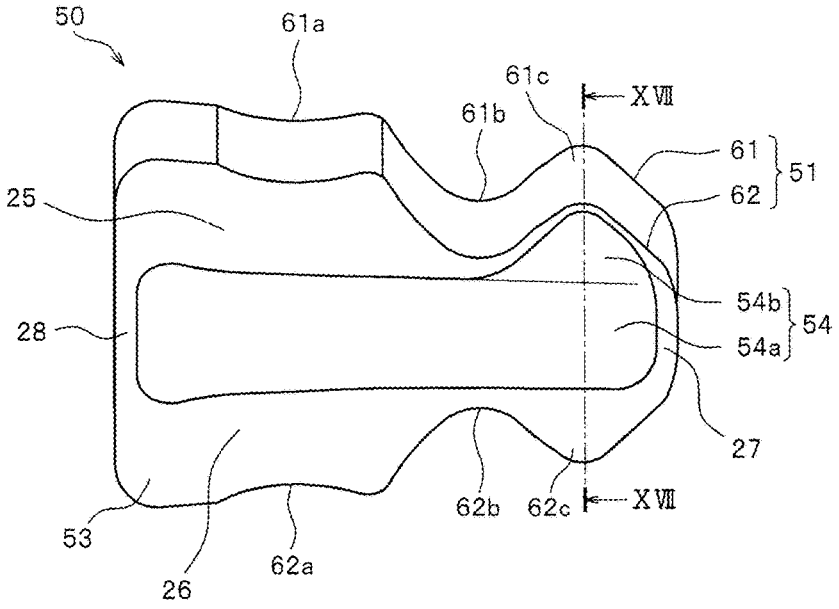
FIG. 14 is a bottom view of the fastener element.
Figure 15:
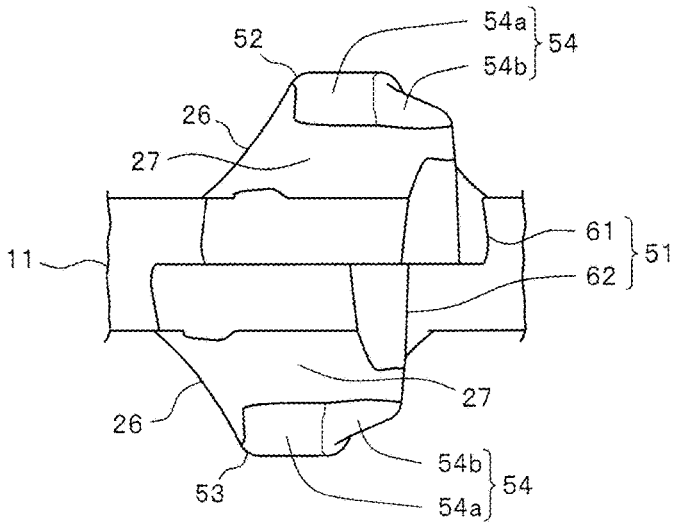
FIG. 15 is a schematic view viewing the fastener element from the coupling head portion side of the central land portion in the tape width direction.
Figure 16:
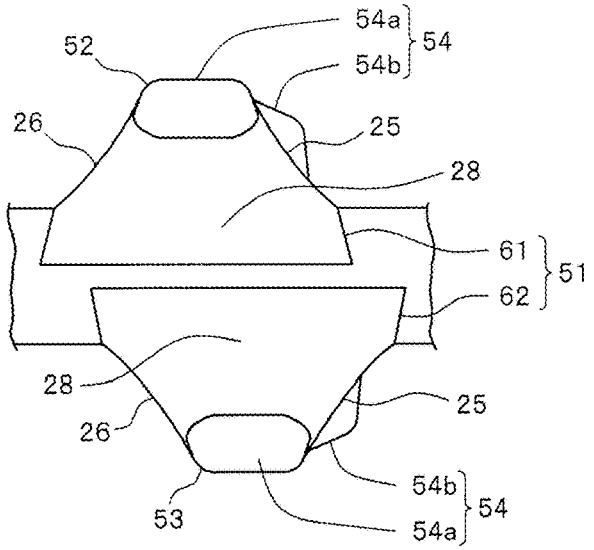
FIG. 16 is a schematic view viewing the fastener element from the leg side of the central land portion in the tape width direction.
Figure 17:
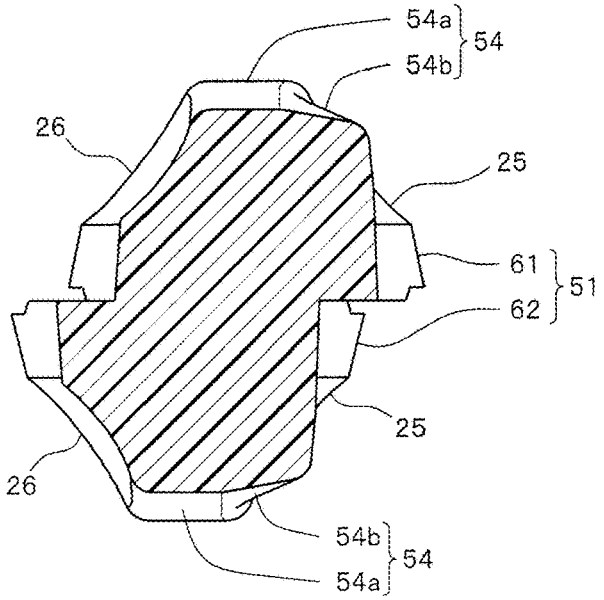
FIG. 17 is a cross-sectional view in XVII-XVII line shown in FIG. 14.

FIG. 13 is a perspective view illustrating a fastener element according to Embodiment 2 of the present invention. FIG. 14 is a bottom view of the fastener element. FIG. 15 is a schematic view viewing the fastener element from the coupling head portion side of the central land portion in the tape width direction. FIG. 16 is a schematic view viewing the fastener element from the leg side of the central land portion in the tape width direction.

It should be noted that, the slide fastener according to Embodiment 2 explained as below has a principal characteristic specific to a fastener element 50, and assemblies or members other than the fastener element 50 have a substantially same structure as the slide fastener 1 according to the above-mentioned Embodiment 1. Accordingly, in Embodiment 2, the structure of the fastener element 50 is mainly explained, and a detailed explanation of assemblies or members other than the fastener element 50 is omitted.

The slide fastener of Embodiment 2 has a pair of left and right fastener stringers in which element rows are formed along opposite tape side edge parts of left and right fastener tapes 11, first stops disposed adjacent to the element rows at top end parts of each fastener stringer, a separable bottom end stop disposed at bottom end parts of the pair of fastener stringers and a slider disposed slidably along the element rows.

Each fastener element 50 of Embodiment 2 has a central land portion 51 disposed at a center part in an element thickness direction, a first bulging portion (front surface side bulging portion) 52 bulging from the central land portion 51 to an upper side and a second bulging portion (rear surface side bulging portion) 53 bulging from the central land portion 51 to a lower side.

The first bulging portion 52 and the second bulging portion 53 of Embodiment 2 themselves have the same shapes as the first bulging portion 22 and the second bulging portion 23 of the above-mentioned Embodiment 1 respectively, and a tapered (triangular-shaped) protrusion end surface 54*b* of the bulging end surface 54 protrudes from a trapezoid-shaped base end surface 54*a* to a top direction.

However, in the central land portion 51 of Embodiment 2, since a first half portion 61 and a second half portion 62 described later are formed in a displaced position in a tape length direction (an element width direction), both the first bulging portion 52 bulging from the first half portion 61 of the central land portion 51 and the second bulging portion 53 bulging from the second half portion 62 of the central land portion 51 are also disposed in a displaced position in the tape length direction (the element width direction).

The central land portion 51 of Embodiment 2 has the first half portion 61 disposed on a tape front surface side of a reference surface positioned at a center of the fastener tape 11 in a tape thickness direction and a second half portion 62 disposed on a tape rear surface side of the reference surface. In this case, though the central land portion 51 is fixed over the tape front surface and the tape rear surface of the fastener tape 11, the first half portion 61 and the second half portion 62 are disposed in a displaced position in the tape length direction (the element width direction).

The first half portion 61 of the central land portion 51 has a body portion 61*a* fixed to a tape side edge part of the fastener tape 11, a neck portion 61*b* extending from the body portion 61*a* to a tape outward in the tape width direction and a coupling head portion 61*c* further extending from the neck portion 61*b* in the tape width direction, and for example, a shoulder portion 21*d* protruding from a neck portion 21*b* and a concave groove portion 21*e* concaved at a tip end part of a coupling head portion 21*c* of the above-mentioned Embodiment 1 are not provided.

Further, though the second half portion 62 of the central land portion 51 also has a body portion 62*a* fixed to a tape side edge part of the fastener tape 11, a neck portion 62*b* extending from the body portion 62*a* to a tape outward in the tape width direction and a coupling head portion 62*c* further extending from the neck portion 62*b* in the tape width direction. However, a shoulder portion 21*d* and a concave groove portion 21*e* of the above-mentioned Embodiment 1 are not provided, similar to the first half portion 61.

In the central land portion 51 having the first and second half portions 61, 62 with such a shape, the coupling head portions 61*c*, 62*c* and the neck portions 61*b*, 62*b* are provided respectively in the first and second half portions 61, 62. Therefore, when the slide fastener is opened and closed by sliding the slider, the left and right fastener elements 50 can be smoothly coupled and separated. In addition, an enough strength for usage (lateral pulling strength) with respect to the lateral pulling force added in the tape width direction can be stably secured.

Further, though such a shoulder portion 21*d* and a concave groove portion 21*e* as in the above-mentioned Embodiment 1 are not formed in the central land portion 51 of Embodiment 2, by displacing a position of the first half portion 61 and a position of the second half portion 62 in the tape length direction, when the left and right fastener elements 50 are engaged, a part of the first half portion 61 (or the second half portion 61) of each fastener element 50 and a part of the second half portion 62 (or the first half portion 61) of the counterpart fastener element 50 overlap in the tape front and rear direction. Accordingly, an enough strength for usage (push-up strength) with respect to the push-up force added in the tape front and rear direction can be stably secured.

Further, for example, since the fastener element 50 of Embodiment 2 is not formed symmetrically in a tape front surface side and a tape rear surface side as in the above-mentioned fastener element 20 of Embodiment 1, the appearance of the fastener element 50 and the slidability of the slider are inferior to the above-mentioned slide fastener 1 of Embodiment 1.

However, since the shoulder portion 21*d* and the concave groove portion 21*e* are not formed in the central land portion 51 of Embodiment 2 as described above, the fastener element 50 of Embodiment 2 has a shape without undercut when a mold for injection molding is opened in the tape front and rear direction. Therefore, in injection molding of the fastener element 50, since a core (slide core) is not needed, the injection molding can be performed easier and more effective than, for example, the above-mentioned fastener element 20 of Embodiment 1.

In addition, in Embodiment 2, for example when the slide fastener is formed by attaching two sliders of a first slider and a second slider to element rows in an opposing direction to each other, there occurs no informality that the operability is different in two sliders.

From the slide fastener of Embodiment 2 in which a plurality of fastener elements 50 having the above-mentioned shape are fixed to tape side edge parts of the fastener tape 11, a similar effect as the slide fastener 1 according to the above-mentioned Embodiment 1 can be obtained.

It should be noted that, the first bulging portion 52 and the second bulging portion 53 of the fastener element 50 of Embodiment 2 has, as described above, a tapered protrusion end surface 54*b* as in the first bulging portion 22 and the second bulging portion 23 of the above-mentioned Embodiment 1. The tapered protrusion end surface 54*b* has a triangular shape which is tapered gradually from the base end surface 54*a* to a top direction which is a protruding direction, and in Embodiment 2, the protrusion end surface 54*b* is formed so as to protrude from the trapezoid-shaped base end surface 54*a* only to a top direction.

Figure 18:
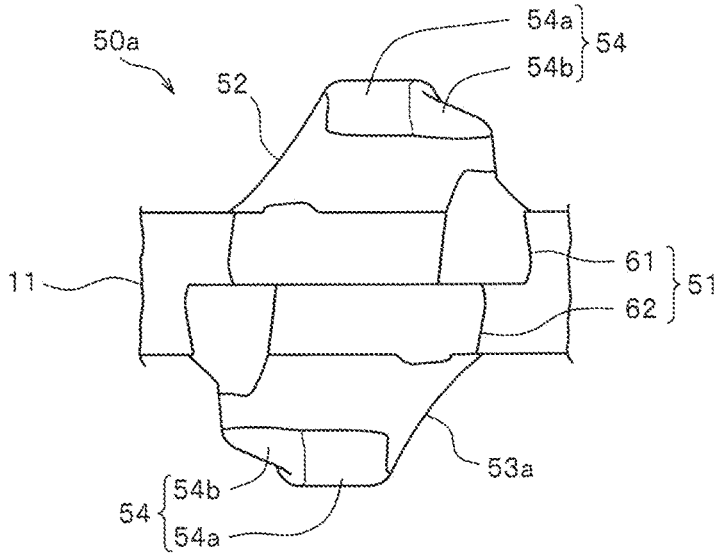
FIG. 18 is a schematic view viewing a fastener element according to a modification example of Embodiment 2 from the coupling head portion side of the central land portion in the tape width direction.
Figure 19:
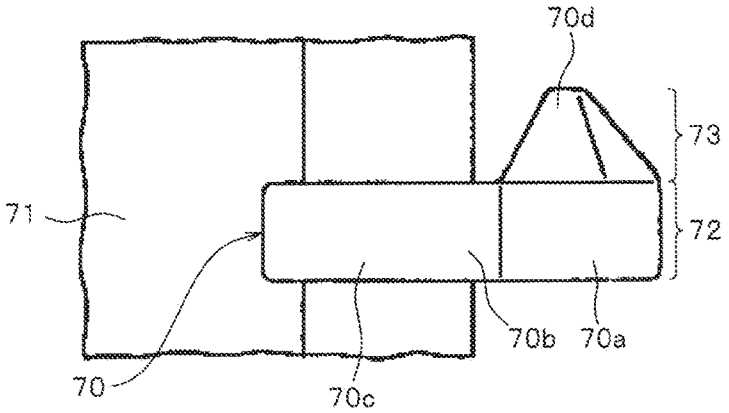
FIG.19 PRIOR ART
FIG. 19 is a plan view illustrating a fastener stringer having a conventional single-sided metal element.
Figure 20:
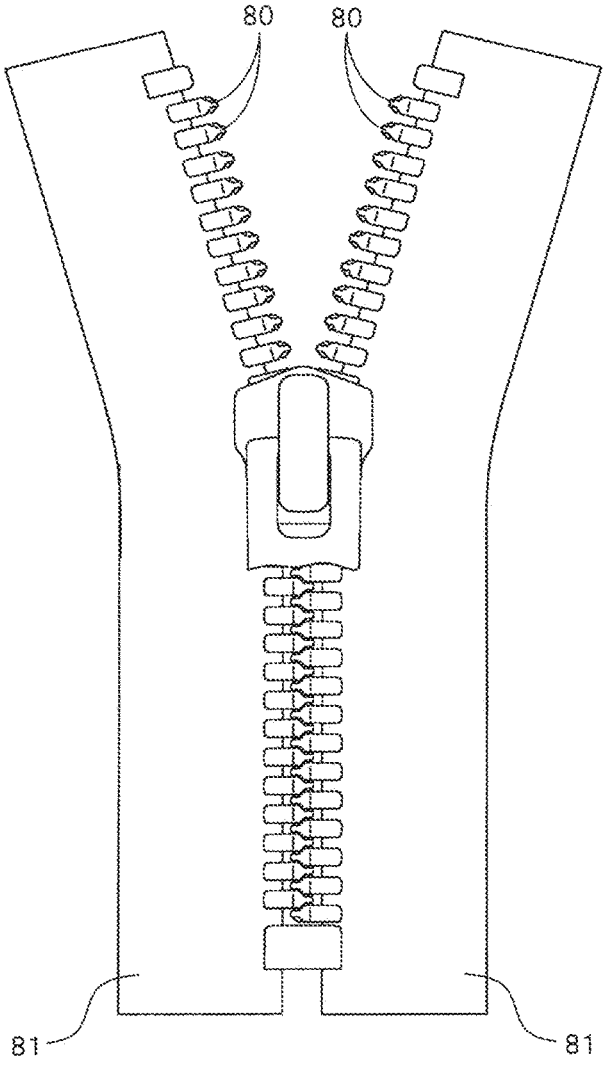
FIG.20 PRIOR ART
FIG. 20 is a plan view illustrating a slide fastener having the conventional double-sided metal elements.
Figure 21:
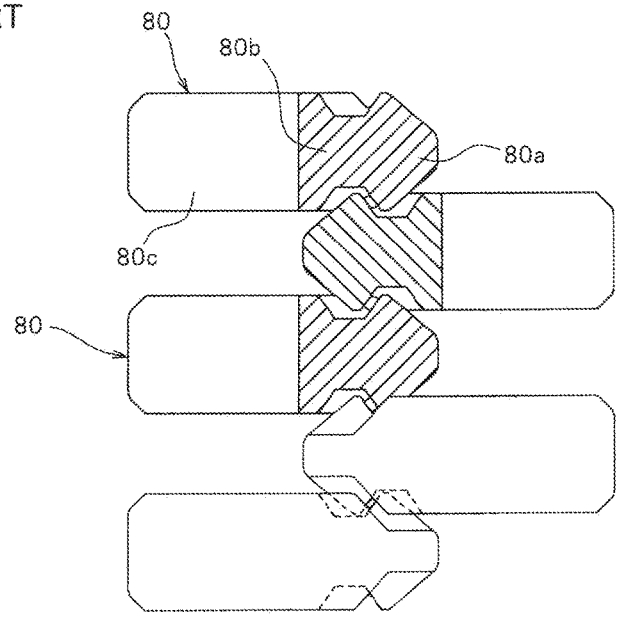
FIG.21 PRIOR ART
FIG. 21 is a main part enlarged view illustrating a state in which the double-sided metal elements of the slide fastener are engaged by showing a cross-section of a part thereof.
Figure 22:
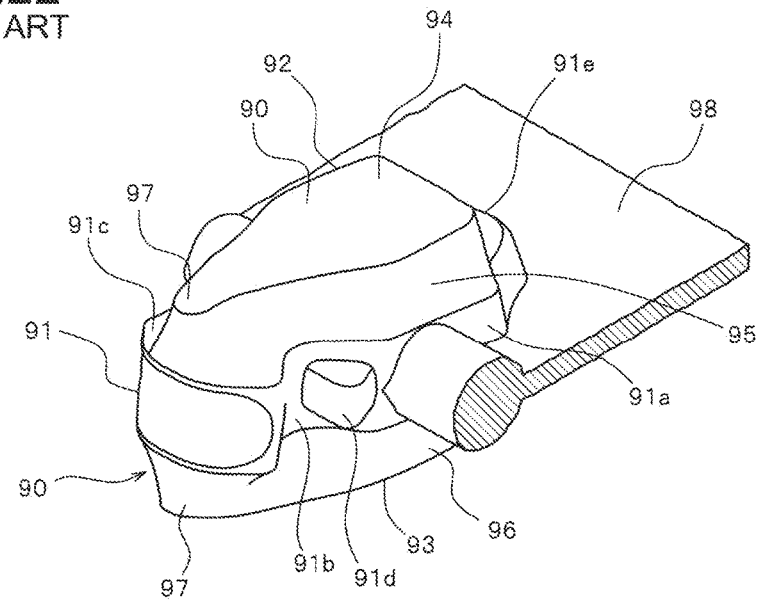
FIG.22 PRIOR ART
FIG. 22 is a perspective view illustrating a fastener stringer having the conventional fastener elements made of synthetic resin having an appearance like the double-sided metal element.
Figure 23:
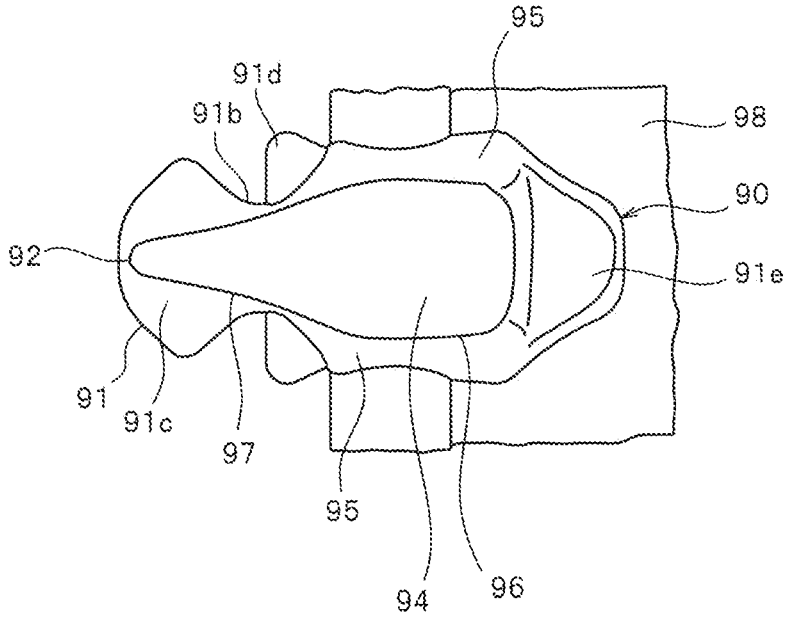
FIG.23 PRIOR ART
FIG. 23 is a plan view of the fastener stringer.

However, the fastener element of the present invention is not limited thereto, and for example the slide fastener may be formed by fixing fastener elements 50*a* according to a modification example of Embodiment 2 shown in FIG. 18 to the fastener tape 11.

Specifically, in the fastener element 50*a* according to the modification example of Embodiment 2, a first bulging portion 52 on a tape front surface side is formed so as a triangular-shaped protrusion end surface 54*b* of a bulging end surface 54 to protrude from a trapezoid-shaped base end surface 54*a* only to a top direction, and is formed the same as the above-mentioned first bulging portion 52 of Embodiment 2 shown in FIGS. 13-17.

On the other hand, a second bulging portion 53*a* on a tape rear surface side is formed so as the triangular-shaped protrusion end surface 54*b* of the bulging end surface 54 to protrude from the trapezoid-shaped base end surface 54*a* only to a bottom direction, and faces to an opposite side with respect to the first bulging portion 52 in the tape length direction.

From the slide fastener having the fastener elements 50*a* according to the modification example in which the first bulging portion 52 on the tape front surface side and the second bulging portion 53*a* on the tape rear surface side are displaced in the tape length direction (the element width direction) and formed so as a direction of the first bulging portion 52 and a direction of the second bulging portion 53*a* to face to an opposite direction each other in the tape length direction (the element width direction), a same effect as in the slide fastener 1 according to the above-mentioned Embodiment 1 or the slide fastener according to Embodiment 2 can be obtained.

Reference Signs List

| | |
|---|---|
| 1 | Slide fastener |
| 5 | First stop |
| 6 | Separable bottom end stop |
| 7 | Insert pin |
| 8 | Box pin |
| 9 | Box |
| 10 | Fastener stringer |
| 11 | Fastener tape |
| 11a | Core string portion |
| 12 | Element row |
| 20, 20' | Fastener element |
| 20a | Fastener element |
| 21 | Central land portion |
| 21a | Body portion |
| 21b | Neck portion |
| 21c | Coupling head portion |
| 21d | Shoulder portion |
| 21e | Concave groove portion |

-continued

| Reference Signs List | |
|---|---|
| 22 | First bulging portion (Front surface side bulging portion) |
| 23, 23a | Second bulging portion (Rear surface side bulging portion) |
| 24 | Bulging end surface |
| 24a | Base end surface |
| 24b | Protrusion end surface |
| 25 | Top side wall surface |
| 26 | Bottom side wall surface |
| 27 | Tip end surface |
| 28 | Tail end surface |
| 30 | Slider |
| 31 | Slider body |
| 32 | Tab |
| 33 | Upper blade plate |
| 34 | Lower blade plate |
| 35 | Guide post |
| 36 | Upper flange portion |
| 37 | Lower flange portion |
| 38 | Tab attaching post |
| 41 | Upper base |
| 42 | Lower base |
| 43 | Oblique side (leg) |
| 45 | Tail end side curved surface |
| 46 | Main base end surface |
| 47 | Declined surface |
| 50, 50a | Fastener element |
| 51 | Central land portion |
| 52 | First bulging portion (Front surface side bulging portion) |
| 53, 53a | Second bulging portion (Rear surface side bulging portion) |
| 54 | Bulging end surface |
| 54a | Base end surface |
| 54b | Protrusion end surface |
| 61 | First half portion |
| 61a | Body portion |
| 61b | Neck portion |
| 61c | Coupling head portion |
| 62 | Second half portion |
| 62a | Body portion |
| 62b | Neck portion |
| 62c | Coupling head portion |
| d | Interval between tail end parts at base end surface of adjacent fastener elements |
| t1 | Width dimension of upper flange portion |
| t2 | Width dimension of lower flange portion |
| θ | Angle formed by protrusion end surface and top side wall surface |

The invention claimed is:

1. A fastener element for a slide fastener made of synthetic resin which is injection molded at tape side edge parts of fastener tapes, having a central land portion fixed to the fastener tape and first and second bulging portions bulging from the central land portion to a tape front surface side and a tape rear surface side in an element thickness direction, wherein the central land portion has a body portion fixed to the fastener tape with a predetermined dimension in an element width direction, a neck portion extending from the body portion to a tape outward side in an element length direction and a coupling head portion further extending from the neck portion in the element length direction, wherein;

the first and second bulging portions have a bulging end surface facing upward or downward in the element thickness direction and a pair of top and bottom side wall surfaces formed from top and bottom side edges of the bulging end surface to the central land portion respectively, the bulging end surface has a quadrilateral-shaped base end surface which is composed of four sides of a tip end edge on the coupling head portion side, a tail end edge of the body portion side and the pair of side edges connecting both ends of the tip end edge and both ends of the tail end edge and is long in the element length direction and also has a protrusion end surface protruding from only a part of one of the side edge out of the pair of top and bottom side edges of the base end surface in the element width direction, and the protrusion end surface is formed on the coupling head portion and has a shape which tapers gradually toward a protrusion direction from the base end surface.

2. The fastener element according to claim 1, wherein the base end surface has a trapezoidal shape with the tip end edge as an upper base, the tail end edge as a lower base and the pair of side edges as a pair of oblique sides, and the lower base is longer than the upper base.

3. The fastener element according to claim 2, wherein the length of the lower base is set to be 1.2 times or less of the length of the upper base.

4. The fastener element according to claim 2, wherein the pair of top and bottom side edges of the base end surface are formed as a curved line curving concavely toward an inside.

5. The fastener element according to claim 1, wherein the protrusion end surface is declined from the base end surface in the element width direction.

6. The fastener element according to claim 1, wherein the base end surface has a sloped surface declining toward the tip end edge in the element length direction.

7. The fastener element according to claim 1, wherein the base end surface is disposed only in a region inside of the neck portion of the central land portion in the element width direction.

8. The fastener element according to claim 1, wherein the protrusion end surface is formed as a plain surface or a convex curved surface, and at least a part disposed on an opposite side of the protrusion end surface out of the side wall surfaces across the base end surface declines toward the central land portion and is formed as a concave curved surface.

9. The fastener element according to claim 1, wherein the central land portion further has a shoulder portion extending from the neck portion in the element width direction and a concave groove portion concaved at a tip end part of the coupling head portion, and is formed in a front-rear symmetrical shape about a reference surface positioned at a center of the fastener tape in the tape thickness direction.

10. The fastener element according to claim 1, wherein the central land portion has a first half portion disposed on a tape front surface side of the reference surface positioned at the center of the fastener tape in the tape thickness direction and a second half portion disposed on a tape rear surface side of the reference surface, and the first half portion and the second half portion are in a displaced position each other in the element width direction.

11. A fastener stringer wherein a plurality of the fastener elements according to claim 1 are fixed to a tape side edge part of the fastener tape.

12. A slide fastener having the pair of fastener stringers according to claim 11 and a slider attached to element rows made of a plurality of the fastener elements.

* * * * *